US010632361B2

(12) United States Patent
Redmond et al.

(10) Patent No.: US 10,632,361 B2
(45) **Date of Patent: *Apr. 28, 2020**

(54) DEVICE FOR FINGER AND HAND PROTECTION IN MARTIAL ARTS

(71) Applicants: Steven Douglas Redmond, Boise, ID (US); Karen Ann Redmond, Boise, ID (US)

(72) Inventors: Steven Douglas Redmond, Boise, ID (US); Karen Ann Redmond, Boise, ID (US)

( * ) Notice: Subject to any disclaimer, the term of this patent is extended or adjusted under 35 U.S.C. 154(b) by 139 days.

This patent is subject to a terminal disclaimer.

(21) Appl. No.: 15/601,290

(22) Filed: May 22, 2017

(65) Prior Publication Data

US 2017/0259158 A1 Sep. 14, 2017

Related U.S. Application Data

(63) Continuation-in-part of application No. 14/027,022, filed on Sep. 13, 2013, now Pat. No. 9,656,141.

(60) Provisional application No. 61/770,228, filed on Feb. 27, 2013, provisional application No. 61/701,387, filed on Sep. 14, 2012.

(51) Int. Cl.
*A63B 71/14* (2006.01)
*A63B 69/00* (2006.01)

(52) U.S. Cl.
CPC ..... *A63B 71/14* (2013.01); *A63B 69/004* (2013.01); *A63B 2069/0042* (2013.01); *A63B 2209/00* (2013.01); *Y10T 16/44* (2015.01)

(58) Field of Classification Search
CPC ..... A63B 69/20–345; A63B 69/04; A63B 2069/0042; A63B 71/14; A63B 69/004; A63B 2209/00; Y10T 16/44
USPC ..... D29/118, 119; 2/16
See application file for complete search history.

(56) References Cited

U.S. PATENT DOCUMENTS

| | | | |
|---|---|---|---|
| 2,717,799 | A | 9/1955 | Jones |
| 2,923,946 | A | 2/1960 | Nielsen |
| 3,228,033 | A | 1/1966 | Ames et al. |
| 3,496,573 | A | 2/1970 | Kuchar et al. |

(Continued)

OTHER PUBLICATIONS

Introducing The Board Breaker, http://www.theboardbreaker.com/, printed Jun. 28, 2012, p. 1-3.

(Continued)

*Primary Examiner* — Nyca T Nguyen
(74) *Attorney, Agent, or Firm* — Pedersen & Company, PLLC; Ken J. Pedersen; Barbara S. Pedersen

(57) ABSTRACT

A protection device for a holder of a martial arts board/target provides protection from direct impact and/or from the force/shock that is transmitted rearward to the hand and wrists of the holder of the board/target. The device receives the board/target holder's fingers, and a slanted floor inside the device urges the fingers into a generally curled or other inwardly-slanted position, and urges the rest of the hand, the wrist, and forearm into ergonomic and safer positions. The device is preferably made of material(s) in a particular hardness range that protects the user's fingers but that also prevents injury to the striker who is hitting/kicking the board/target. There are preferably no flanges or stops that limit placement of the device to particular places on the board, but rather the holder determines and controls the placement.

29 Claims, 15 Drawing Sheets

(56) References Cited

U.S. PATENT DOCUMENTS

| | | | | |
|---|---|---|---|---|
| 3,903,546 | A | 9/1975 | Rhee | |
| 4,400,829 | A | 8/1983 | Willis | |
| 4,497,073 | A | 2/1985 | Deutsch | |
| 4,635,300 | A | 1/1987 | Rhee | |
| 4,776,584 | A | 10/1988 | Tilley et al. | |
| 4,807,302 | A | 2/1989 | Cannella | |
| 4,908,881 | A | 3/1990 | Field | |
| 4,977,621 | A | 12/1990 | Richard | |
| 5,136,725 | A * | 8/1992 | Montero | A63B 71/148 2/16 |
| D338,742 | S | 8/1993 | Cherepanov | |
| 5,232,368 | A | 8/1993 | Morgia | |
| 5,274,846 | A | 1/1994 | Kolsky | |
| 5,343,562 | A | 9/1994 | Bible | |
| 5,458,564 | A | 10/1995 | Franzen | |
| 5,566,390 | A | 10/1996 | Clancy | |
| 5,595,518 | A | 1/1997 | Ours | |
| 5,983,408 | A | 11/1999 | Li | |
| 6,219,843 | B1 | 4/2001 | Passi et al. | |
| 6,240,558 | B1 | 6/2001 | Makris et al. | |
| 6,612,632 | B2 | 9/2003 | Campbell | |
| 6,711,747 | B2 | 3/2004 | Carlin | |
| 7,165,270 | B2 | 1/2007 | Deyoung et al. | |
| 7,207,928 | B2 | 4/2007 | Arrington | |
| 7,296,300 | B2 | 11/2007 | Votolato | |
| 7,299,506 | B1 | 11/2007 | Samaroo | |
| D575,460 | S * | 8/2008 | Patel | D29/118 |
| 3,037,549 | A1 | 10/2011 | Saur et al. | |
| D651,356 | S | 12/2011 | Logan et al. | |
| D651,357 | S | 12/2011 | Logan | |
| 8,087,101 | B2 | 1/2012 | Ferguson | |
| D657,095 | S | 4/2012 | Logan | |
| 8,844,080 | B2 | 9/2014 | Stacy | |
| 2012/0227198 | A1 * | 9/2012 | Blaszczec | A46B 5/0012 15/160 |
| 2015/0080193 | A1 | 3/2015 | Redmond et al. | |
| 2016/0250537 | A9 | 9/2016 | Redmond et al. | |

OTHER PUBLICATIONS

Various Breaking Board Holders. Superior Martial Arts Supplies, http://superiormartialarts.com/cgi-bin/uniform/perlshop.cgi?ACTION=thispage&thispage= . . . , printed Jun. 28, 2012, pp. 1-7.

Board Breaker, Century, http://www.centurymartialarts.com/Targets_and_Shields/Targets/Board_Breaker.aspx, printed Jun. 28, 2012.

Present Applicant's portrayal of commercial product similar to Cannella Patent No. 4,807,302, excerpt from "prior art" drawings in present application, commercial product available prior to Sep. 2012.

* cited by examiner

DEVICE FOR FINGER AND HAND PROTECTION IN MARTIAL ARTS

This application is a continuation-in-part of Non-Provisional application Ser. No. 14/027,022, filed Sep. 13, 2013 and issued on May 23, 2017 as U.S. Pat. No. 9,656,141, which claims benefit of Provisional Application Ser. No. 61/701,387, filed Sep. 14, 2012 and entitled "Finger Armor", and claimed priority of Provisional Application Ser. No. 61/770,228, filed Feb. 27, 2013 and entitled "Device for protecting hands in martial arts", the disclosures of all of these applications being incorporated herein by this reference.

BACKGROUND OF THE INVENTION

Martial artists use board breaking as a method to demonstrate various attributes such as proper technique, power, targeting and speed among others. Board breaking is used in rank advancement testing, competitions, and even setting Guinness™ world records. Breaking boards requires one or more fellow students to hold the board (referred to as "holders") for the student performing the technique (referred to as a "breaker"). While hand techniques are usually very accurate, foot techniques used in board breaking are usually not very accurate. High speed breaking techniques, particularly kicks, can cause noticeable injury to the hands and fingers of the holder(s) due to poor targeting by the breaker. Once struck/injured, a holder is likely to "flinch" or move the board/target on subsequent attempts, increasing the difficulty of successfully breaking the board/target.

Prior art attempts at providing some hand protection have been generally unsuccessful, for example, benefitting only the holder, or compromising between benefitting the breaker and benefitting the holder to the point that neither attempt at protection has worked. A prior art attempt at providing hand protection is illustrated by the sheath (12) in U.S. Pat. No. 4,807,302 by Cannella. A prior art product very similar to the disclosure of Cannella, and marked in the past with the Cannella patent number, has been and is commercially available, but it does not include the spikes 14 shown in the Cannella drawings. Other prior art attempts at hand protection include the holder(s) wearing of padded gloves.

Increased Chance of Injury:

The inventors believe, in order to avoid or minimize the chance of injury, a holder should hold a board/target with the hand and fingers generally in the position shown by the bare-hand portrayal in FIG. 1A. This places the metacarpophalangeal joints ("knuckles" K) directly adjacent to (directly above in the drawing) the edge of the board B and at or very close to the central plane CP of the board. Further, the inventors prefer that the hand and forearm lie in positions wherein the heel H of the palm is slightly distanced from the board (see P1) and closer to the outer perimeter region E of the board, rather than being closer to the central region CB of the board, which is understood to be below FIG. 1A. Note the curved dashed line in FIG. 1A that indicates that many martial arts boards have a non-planar rear surface, due to the outer perimeter regions being the thickest portion of the board and the central region CB being of lesser thickness and/or having break joints. The front surface of a martial arts board is typically planar, represented by the front plane FP in FIG. 1A, and the outer perimeter edge surface ES is typically planar and perpendicular to the front surface and front plane FP.

These preferred hand and forearm positions may be described as the hand/wrist being rotated into the position in FIG. 1A from the position of FIG. 1B, which for these figures is a counterclockwise rotation. Note that, in FIG. 1B, the knuckles K are behind the central plane and the rear surface of the board, and the heel H of the palm is pressed against the board and closer to the center region CB of the board.

The preferred position results in an angle between the main portion of the hand (and/or the palm) and the forearm is a large obtuse angle O1 and small supplementary angle A1. The inventors prefer an angle O1 of greater than or equal to 135 degrees and a corresponding supplementary angle A1 of equal to or less than 45 degrees. Possible ranges for the obtuse angle O1 may be, for example, 135-160 degrees, or especially about 135-155 degrees. Possible ranges for the acute angle A1 may be, for example, 45-20 degrees, or especially 45-25 degrees.

The Cannella sheath CAN-S and said prior art commercial product COMM, on the other hand, are adapted to hold the fingers, hand, and wrist in positions substantially similar to those portrayed by the bare-hand holding the board in FIG. 1B. When the Cannella CAN-S and commercial product COMM are used, as shown in FIGS. 2A and 3A, respectively, the fingers, hand, and wrist positions stay similar to those in FIG. 1B. FIGS. 2A and 3A show that the fingers inside the Cannella/commercial-product, up to about the proximal inter-phalangeal joint (that is, the distal phalanx and the middle phalanx), lie parallel to and close to the front plane FP and the central plane CP of the board/target.

When inside the Canella sheath CAN-S, as shown by FIG. 2A, the fingers' distal phalanx and the middle phalanx are parallel to the board, distanced evenly all along their lengths from the front surface of the board by spikes ("14" in Cannella) and by the thickness of the underside ("18" in Cannella) of the sheath. Note, too, in FIG. 2A, that the metacarpophalangeal joints (knuckles K) lie rearward of the central plane CP of the board. The palm lies tight against the rear surface of the board (see P2) and the wrist W is closer to the center region of the board than in FIG. 1A. The angle O2 of the forearm to the palm is smaller than angle O1, for example, less than 135 degrees, and more typically in the range of about 110-134 degrees. The corresponding supplementary angle A2 in the Canella sheath, therefore, is greater than 45 degrees, and more typically in the range of about 70-46 degrees. Note that the board outer perimeter region E region, which is typically the thickest region of a martial arts target board, is shown with front and rear surfaces parallel to each other, but the board may have a reduced thickness and/or curved rear surface nearer to the center of the board as shown by the curved line C.

The commercial product is likewise adapted so that the fingers, up to about the proximal inter-phalangeal joint (especially the distal phalanx and the middle phalanx), lie parallel to the front plane and the central plane of the board/target. In the commercial product COMM, as shown by FIG. 3A, the fingers' distal phalanx and middle phalanx are parallel to the board, distanced evenly from the front surface of the board, only by the thickness of the underside of the sheath. Note in FIG. 3A that the metacarpophalangeal joints (knuckles K) lie rearward of the central plane CP of the board. The palm lies tight against the rear surface of the board (see P3) and the angle of the forearm to the palm O3 and the supplementary angle A3 are the same or nearly the same as O2 and A2 of the sheath of the Cannella patent, described above.

In summary, the surface that the user's fingers rest on, inside these prior devices, is parallel to the board, requiring the holder's fingers distal and middle phalanx to lie flat/ parallel relative to the board's front and central planes, and forcing the heel of the holder's palm toward the board and further in toward the center of the target. These features of the prior art devices increases the likelihood of "jamming" the holder's wrist(s) as a result of a kick/strike.

Further, the Cannella sheath is described as "made of a tough, substantially nondeformable, abrasion and cutting resistant material, such as plastic or metal". The prior art commercial product related to Cannella is advertised as being made of Lexan™ polycarbonate, which the inventors note is hard, rigid, and completely-inflexible, and tends to become brittle over time making it more susceptible to breaking/shattering when struck. Also, as shown to best advantage in FIGS. 2B and 3B, both the Canella sheath and the commercial product comprise a flange FL (reference 28 in Cannella) that protrudes rearward from the sheath. This flange FL extends along, and typically rests against, the outer perimeter edge surface ES of the board to control and limit the position of the sheath on the board. Thus, the flange FL extends behind the front plane FP of the board and does not contact the front surface of the board. This flange FL is believed by the inventors not only to limit the user's options for hand placement when holding the board, but also to increase the likelihood of breaker injury due to the introduction of rigid surfaces/edges into the target area.

Inadequate Gripping Surface:

Padded gloves commonly available in martial arts circles may protect the holder's fingers to some extent, and may provide a cushioned surface should the breaker hit the glove. However, even conventionally-padded, prior art martial arts gloves decrease the holder's grip, resulting in the target acting "slippery" and being difficult to hang on to. Gloves with increased padding would only interfere further with the holder's grip on the board. The result of padded gloves, therefore, is typically a reduced grip on the target, increasing the likelihood of dropping or prematurely releasing the board/target during the attempt and resulting in a missed attempt on the break.

Therefore, there is still a need for an improved device for finger protection in martial arts, and embodiments of the invention meet this need. Certain embodiments of the invention provide correct ergonomic positioning that is very different from the positioning encouraged by prior art sheaths. Also, certain embodiments of the invention provide the holder with multiple options for hand and protector placement on the board, while also providing a sure grip. Also, certain embodiments comprise firm, but non-injuring and slightly-compressible, elements and surfaces that provide a surprisingly-effective balance of protecting/shielding the holder's hand/fingers and protecting the striker's foot and toes in the case of striking with the foot, or hands and fingers in the case of striking with the hand.

SUMMARY

Figure 1A:
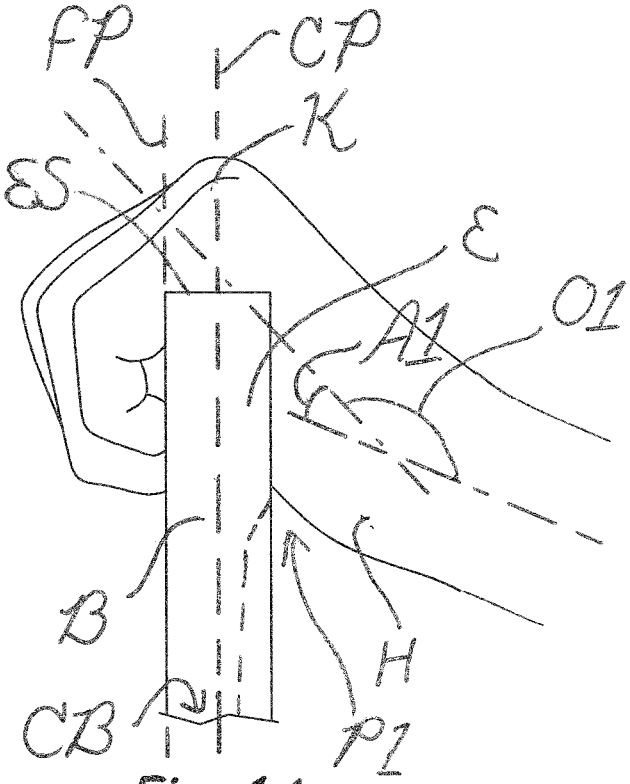
FIG. 1A is a side view of a holder grasping a martial arts board with his/her bare hand, with the hand rotated counterclockwise to an ergonomically-beneficial position.

The invention comprises a device and/or method for protecting the fingers, hand, and/or wrist of a person holding a board or other target that a martial artist attempts to hit or kick with a hand or foot. In this description and in the claims, the term "striker" is used as a broad term that may include both a person kicking a board and a person hitting with the hand or any body part. Said protection may be protection from direct impact, for example, kicking of the fingers, and/or from the force/shock that is transmitted rearward to the hand and wrists of the holder of the board/target.

The device comprises an enclosure for receiving and holding multiple of a board/target holder's fingers in a generally curled or other inwardly-slanted position, as the user grips/grasps the board/target between the device and the user's palm. The structure of the device, and especially a slanted floor of the enclosure, result in said curled or inwardly-slanted position for the fingers, which places the rest of the hand, the wrist, and forearm in ergonomic and safe positions. In certain embodiments, the device is made entirely or substantially of material(s) in a particular hardness range that protects the user's fingers but that also tends to prevent injury to the person hitting/kicking the board/target.

In certain embodiments, an interior space inside the device is adapted to receive the user's finger(s) so that the holder(s) may use two of the devices, one on each hand, to hold a board/target generally in front of or to the side of the holder(s) for presentation to the striker. The board is typically held generally vertical, for example for side-kicks, or at other angles, such as 5-45 degrees from vertical for other types of front or round kicks, or generally parallel to the floor (flat or almost flat) for ax kicks. Typically, two holders are required or desired to hold a single board. Based on the orientation typically seen when the device is in use, structure behind the interior space rests on the board/target and structure in front of the interior space shield the fingers from direct impact. The rear portion of the device may comprise a rear wall, called in certain embodiments a "floor", against which the fingers press, and one or more extension members/surfaces that extend out rearwardly from the floor wall to lie on a rear plane of the device. Said one or more extension members/surfaces is/are sized and shaped so that, when the extension members/surfaces is/are placed against the front surface of the board/target, the device is so oriented that the rear wall/floor is at an angle to the front surface of the board/target.

In certain embodiments, the device is adapted to be adjustable in position on the board/target, to give the user flexibility in grasping different portions of the board/target. Preferably, the device comprises no protrusions extending rearward of said rear plane, and thus, no protrusions extending rearward of the front surface of the board. Particularly, the device preferably comprises no plate or protrusion(s) that extend(s) along, around or behind the outer perimeter edge surface ES of the board/target, and no plate or protrusion(s) that contact the outer perimeter edge surface ES or the rear surface of the board/target. Such plate(s) or protrusion(s) could interfere or limit the placement of the device relative to the board, and, therefore, the preferred device (missing such plate(s) and protrusion(s)) may be moved inward relative to the outer perimeter edge.

Objects of certain embodiments of the invention, therefore, comprise implementing a protective device, for a martial arts' board/target holder's hands, that provides both impact and ergonomic benefits for the holder(s). Another object of certain embodiments is that employing such a device should not dramatically increase the likelihood of injury to the breaker compared to the breaker hitting/kicking a board/target that is held with bare hands and/or soft/flexible gloves.

DETAILED DESCRIPTION

Referring to the Figures, there are shown examples of bare hands holding a martial arts board, and also two prior art devices being used in holding a martial arts board. Also shown in the Figures are several, but not the only, embodiments of the invented, improved device for finger and/or hand and wrist protection in martial arts and methods of using the embodiment. Martial arts boards, including rebreakable boards, are well-known in the art.

Figure 1B:
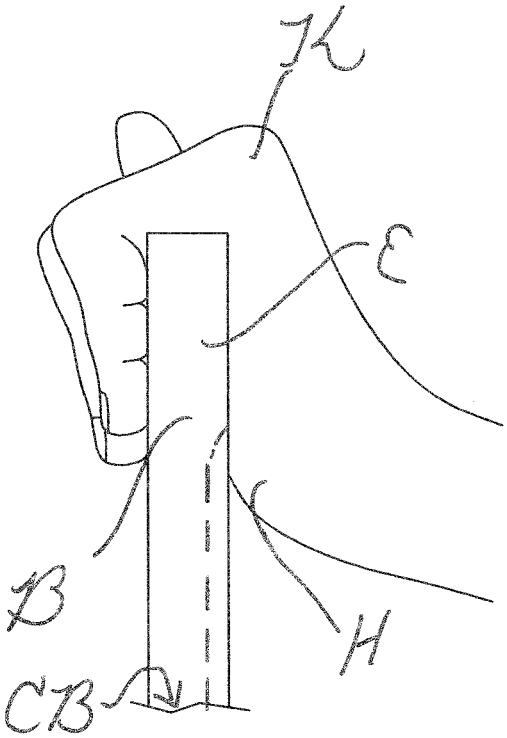
FIG. 1B is a side view of a holder grasping a martial arts board with his/her bare hand, with the hand rotated clockwise to a non-ergonomically-beneficial position.
Figure 4:
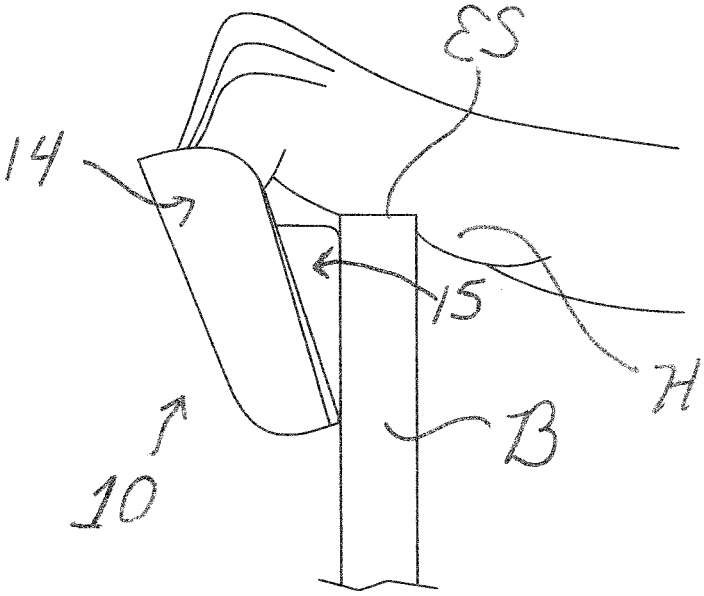
FIG. 4 is a side view of a holder using one embodiment of the invented protection device to hold a board.
Figure 2A:
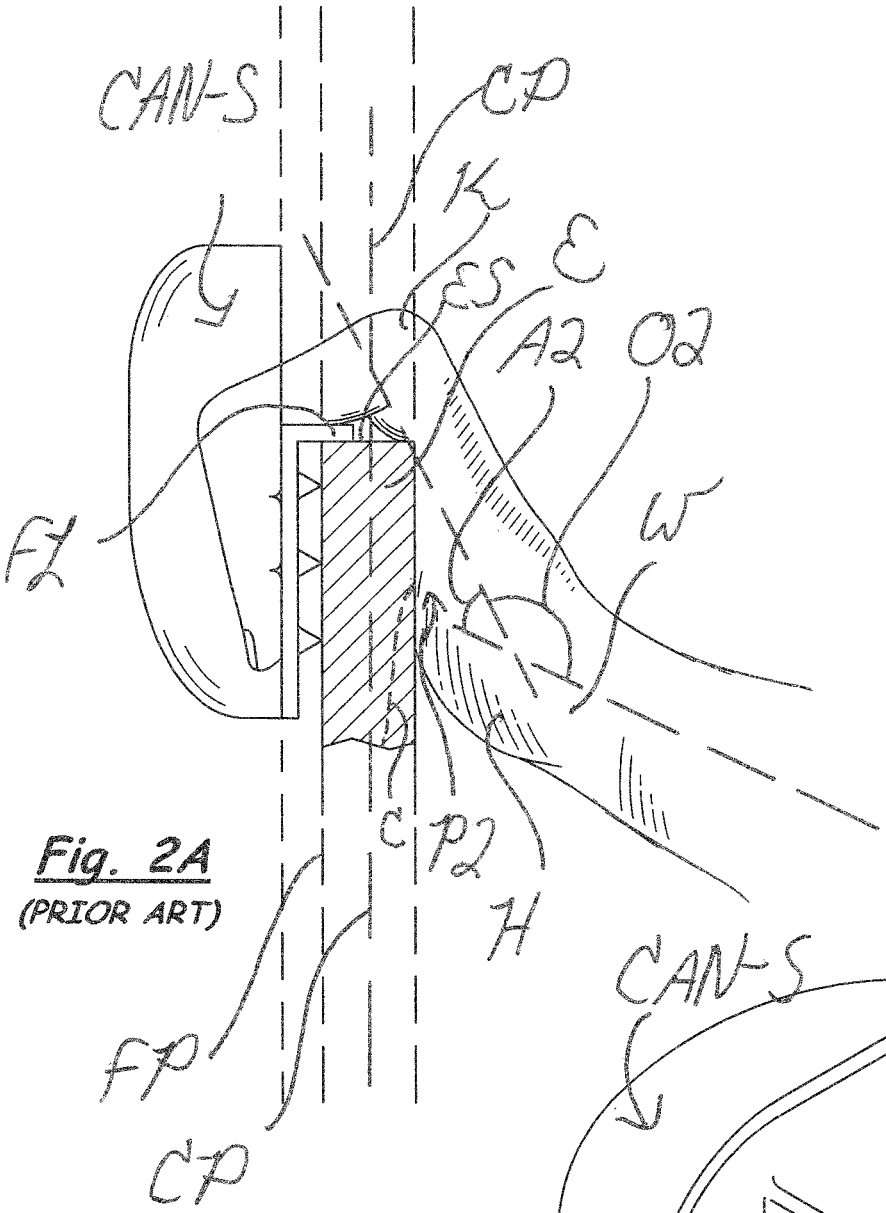
Fig. 2A (PRIOR ART)
FIG. 2A is a side view of a holder using a prior art sheath such as that disclosed in Canella, U.S. Pat. No. 4,807,302, to grasp a martial arts board, resulting in the hand being rotated clockwise in this figure.

Device 10 is representative of one, but not the only, embodiment of the invented device for finger protection in martial arts. FIG. 4 (on the same page as FIGS. 1A and 1B) and FIG. 6B show to best advantage examples of how the device 10 may be worn, and how the device 10 tends to cause the user's (holder's) hand to be rotated counterclockwise in FIG. 4 and clockwise in FIG. 6B, relative to the board B, compared to the un-ergonomic and possibly-injurious positions of FIGS. 1B, 2A, and 3A. One may see in FIGS. 4 and 6B that the distal portions of the fingers are curled/slanted, the knuckles are forward, and the wrist is straightened, compared to the prior art approaches.

Figure 6A:
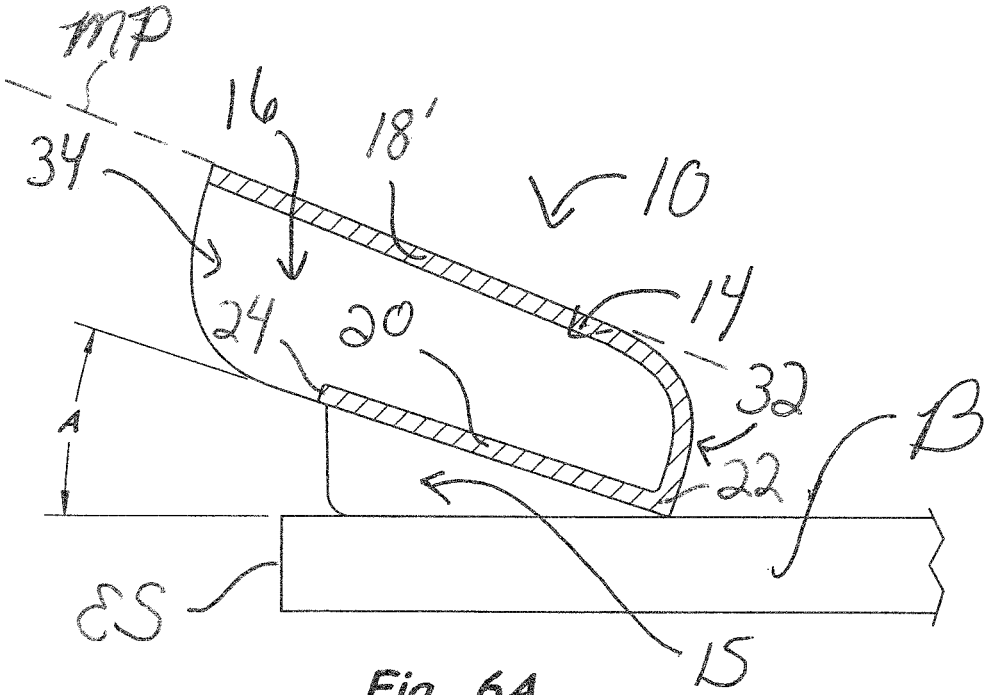
FIG. 6A is a cross-sectional view of the device of FIG. 4 on a martial arts board, showing an example angle A of the floor of the finger compartment relative to the surface of the board, showing that no portion of this device extends along or contacts the outer perimeter edge of the board.
Figure 6B:
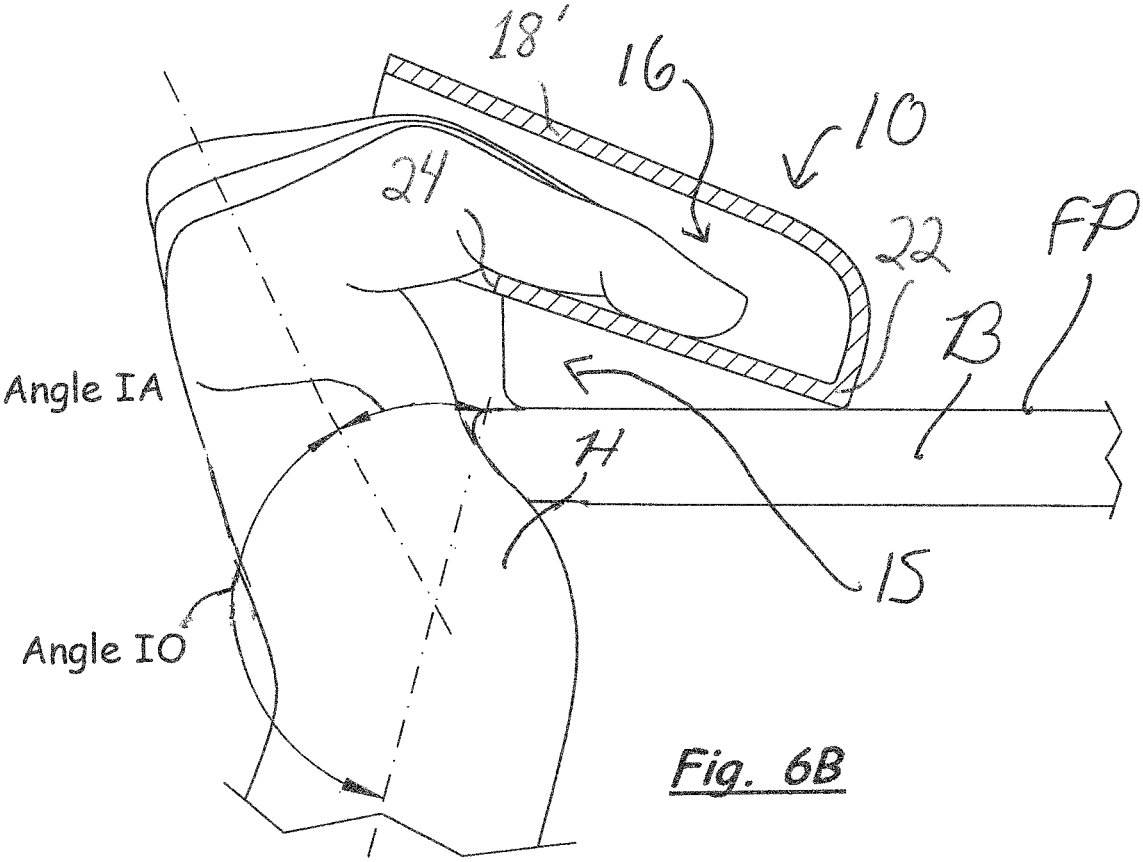
FIG. 6B shows the device and board of FIG. 6A in use by a holder's hand.
Figure 7:
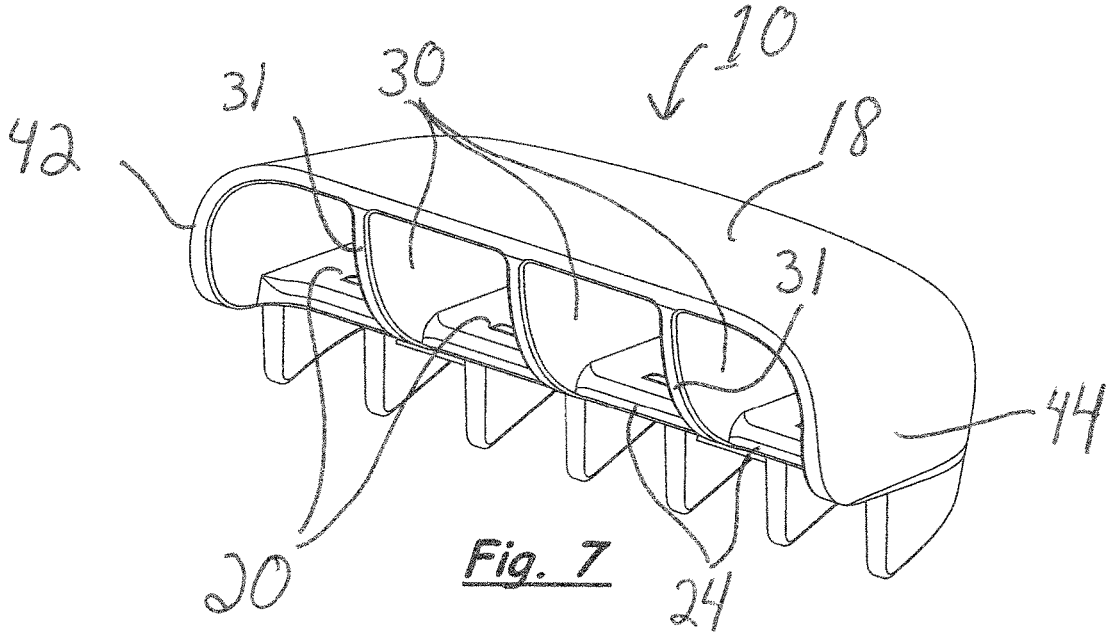
FIG. 7 is an proximal perspective view of the device of FIG. 4.

As shown to best advantage in FIGS. 4 and 6A and B, device 10 is worn on the fingers of the holder's hand and is comprised of an enclosure 14 (or "finger compartment" or "pocket space") and a rear portion 15 that extends rearward (to the right in FIG. 4) to rest on and grip the board. The enclosure 14 surrounds multiple sides of an interior space, and hence defines the interior space 16 into which the user slides his/her fingers. The main walls forming the enclosure 14 are a curved front wall 18 and a floor wall ("floor") 20. The front wall 18 curves from side-to-side in front of (or "over") the interior space 16 and, hence, in front of the distal phalanx and the middle phalanx of the hand. The floor is a generally flat and planar wall that extends side to side behind (or "under") the interior space 16, and, hence, behind the distal phalanx and the middle phalanx.

As shown to best advantage in FIGS. 7-9 and 13, one or more dividers 30 are provided in the interior space 16, extending at least part of the way (and preferably all the way) between the closed end 32 and opening 34 of enclosure 14, and extending from the inner surface of the front wall 18 to the inner surface of the floor 20. Preferably three dividers are used, for creating four sub-compartments 36, 37, 38, and 39 (see FIGS. 8 and 9) of the interior space 16. These dividers 30 are walls that are transverse to the floor 20, serving to separate the holder's fingers received in the interior space 16 and to provide surfaces against which the fingers may push or otherwise apply force during holding the target and in reaction to a strike. The dividers therefore may play roles in the generally-evenly-spaced-apart fingers applying rearward force to the device by means of force spread-out across the floor, and applying sideways force to the device by means of force on one or more of the dividers. In addition, having four fingers separated in four small sub-compartments 36-39, helps with control of the device by the fingers/hand and in preventing the device from pivoting relative to the fingers or falling off the fingers. In addition, as emphasized schematically in FIG. 13, the dividers 30 and the sidewalls 42, 44 help spread-out the load of a strike, for example, transferring force from the top of the front wall 18, to the sidewalls 42, 44 and through the dividers 30 to the floor 20, and then to the bottom ends of the sidewalls 42, 44 and to the extensions 50, thus shielding the fingers and helping to prevent collapse of the enclosure 14.

The floor 20 of the enclosure 14 connects, or is integrally attached to, the side wall portions 42, 44 of the front wall 18 and the distal portion 46 of the front wall. One may say the front wall 18 curves all the way to the floor 20 at two sides and at the distal end of the device, or one may say that the front wall 18 comprises sidewall portions 42, 44 and distal wall portion 46 that connect to the floor 20. The device's enclosure walls (18, 42, 44, 46, 20) are usually solid and continuous, but may optionally incorporate one or more openings for air ventilation. In FIGS. 6A and B, 8, and 12, one may see the portion referred to as the main portion 18' or top portion of the front wall 18. This main portion 18' is a generally planar portion of the front wall 18, typically being on a plane MP that is at an angle of about 30-40 degrees from the rear plane RP, for example, and/or at an angle of about 10-25 degrees from the plane of the rear wall (floor 20), for example.

Figure 11:
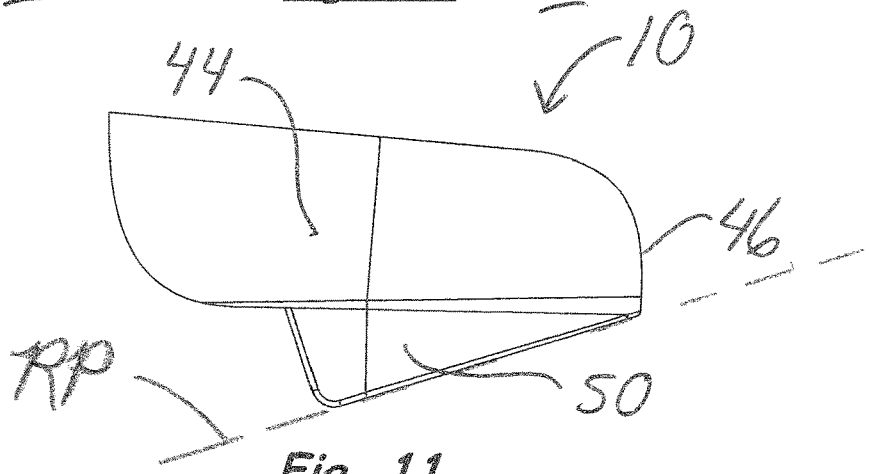
FIG. 11 is a side view of the device of FIG. 4, with the device rotated to make the floor wall generally horizontal.
Figure 12:
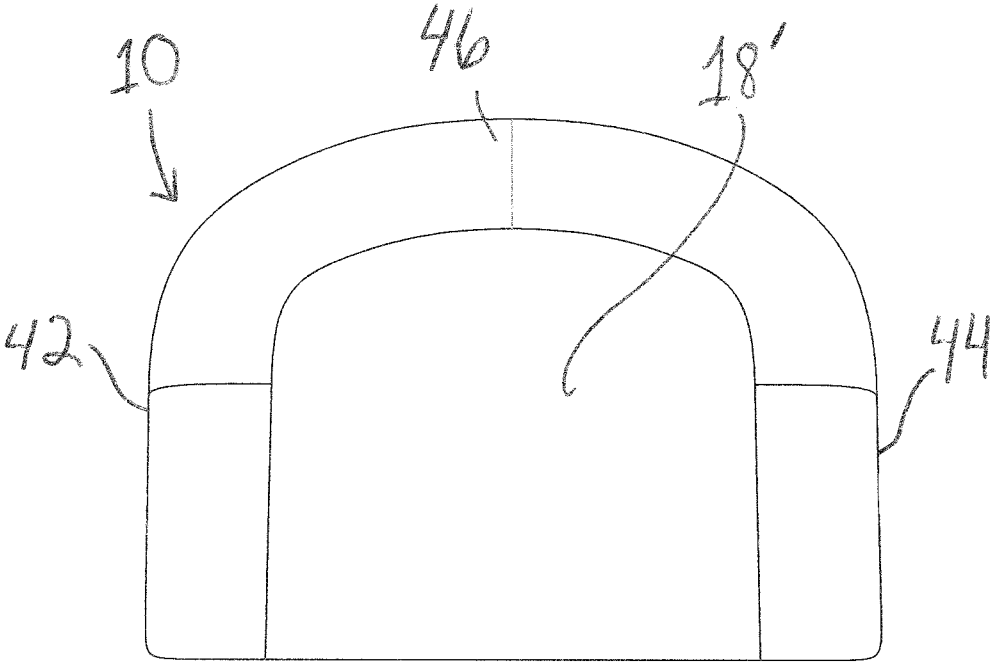
FIG. 12 is a top view of the device of FIG. 4.
Figure 13:
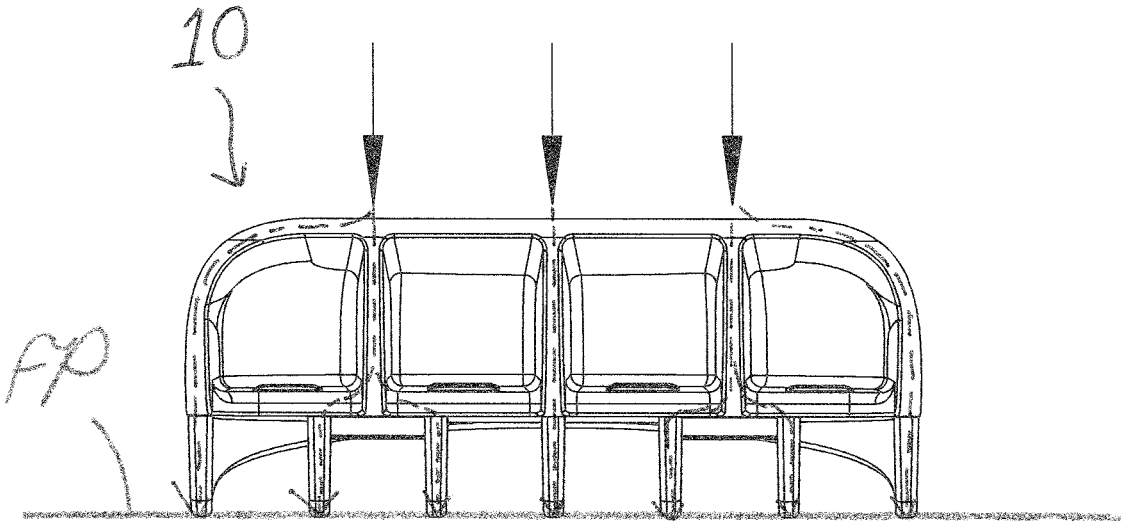
FIG. 13 is a proximal end view of the device of FIG. 4 illustrating force arrows so the viewed may note how the dividers of the finger compartment and the rearward extensions will transfer the force to the board (which would be below the device in this figure).

Extending rearward from the enclosure 14 is at least one rear portion of the device, which, in device 10, takes the form of multiple rearward-protruding extensions 50. These extensions 50 are generally transverse to the plane of the floor 20, and are generally parallel to the dividers 30 of the interior space. These extensions 50 each have a rear extremity that lies on the same plane, thus, defining a rear plane RP of the device (see FIGS. 8 and 11). The rear extremities of the extensions 50, in this embodiment, are rear edges 56 that all lie on the rear plane. Extensions 50 are longer, or in other words extend farther from the floor 20, at or near the proximal end of the device (opening 34), compared to their length at or near distal end of the device (closed end 32). The extensions 50 are generally triangular walls or "fins" extending/protruding rearward from the floor of the enclosure. Thus, the extensions 50 all rest on the front surface/plane FP of the board, to hold the floor farther from the board B at the proximal/open end of the device than at the distal/closed end of the device, resulting in the floor 20 being at an angle A to said rear plane, as illustrated in FIG. 6A. Note that extensions of sidewalls 42, 44, on the far left and right in FIG. 8, may be described as triangular, have rearward extremities on the rear plane RP, and are counted as two of the seven triangular extensions 50. These sidewall extensions, which may be fixed to or integral with the sidewalls 42, 44, provide additional stability for the device on the board by virtue of being at the far left and right extremities of the device.

Thus, it may be said that, in certain embodiments, interior structure inside the device causes/urges the fingers to rest in said curled, inwardly-slanted, or other non-parallel position relative to the front plane and the central plane of the board/target. As shown in FIG. 6A, this may be done in certain embodiments by the surface against which the fingers rest being at an angle A to said rear plane of the rearmost extremity(ies), and hence at the same angle to the front surface of the board/target against which the rearmost extremity(ies) rest. In certain embodiments, angle A may be in the range of 5-45 degrees, for example, but the inventors have determined that angle A is more preferably between about 10-25 degrees, more preferably A is 16-20 degrees and especially-preferably angle A is about 18 degrees. With floor 20 being thus-angled or thus-slanted, the user can grasp the board/target securely between the device (with fingers inside) in front of the board/target, and the user's palm against or near the rear surface of the board/target, but the fingers are shielded, and the fingers, hand, wrist and forearm are in what the inventors refer to as "proper positions", that is, ergonomic, comfortable, and safe positions. Due to the strength needed to safely and effectively hold the board/target and the force with which the striker may kick/hit the board/target, these proper positions, further described below, may be matters of slight changes in position of the fingers, hand, wrist and/or forearm and/or their angles to each other.

FIG. 6B illustrates the finger, hand, and wrist positions of the holder when using device 10. This "proper holding position" comprises 1) the fingers being "curled" or otherwise slanting toward the board, which appears as slanting downward in this view; 2) the metacarpophalangeal joints ("knuckles" K) of the hand being generally aligned with (closely adjacent and generally centered over) the outer perimeter edge E and central plane of the board/target; and 3) the wrist angle IO (palm to forearm) being greater than or equal to 135 degrees, for example, about 135-160 degrees, or especially about 135-155 degrees, and corresponding supplementary angle IA being less than or equal to 45 degrees, or 45-20 degrees, or especially 45-25 degrees.

Figure 5A:
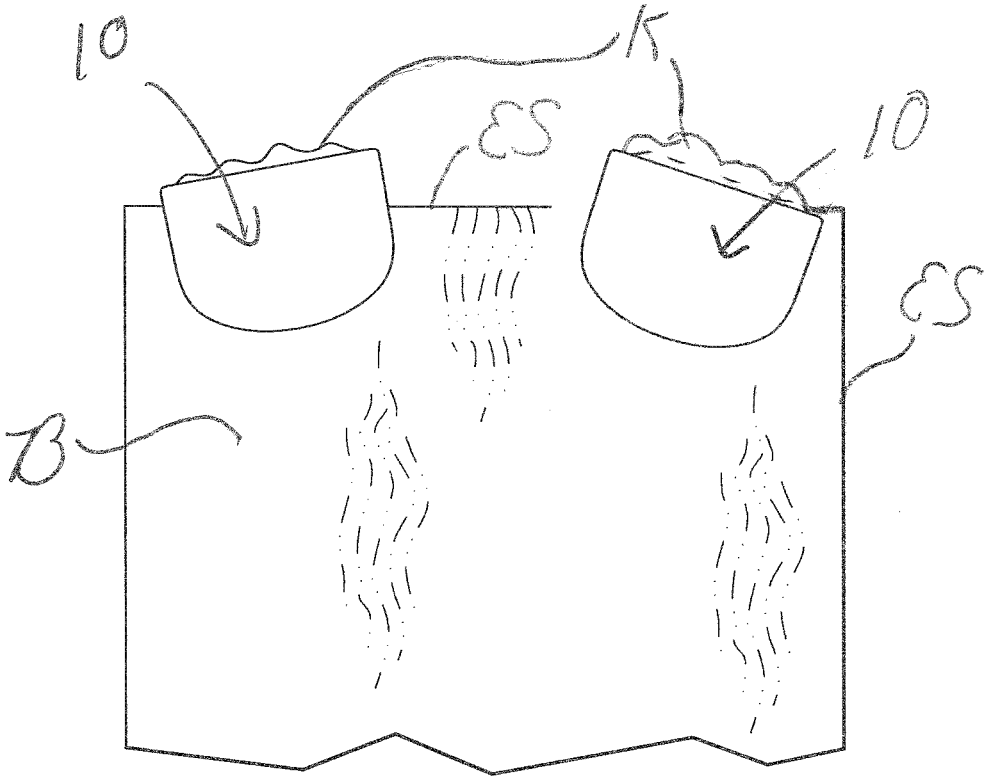
FIG. 5A is a schematic front view of two of the protection device embodiments of FIG. 4 being used by a holder in right and left hands to grasp a martial arts board, wherein the devices and the holder's hands are at angles to the top edge of the board that is being grasped.
Figure 5B:
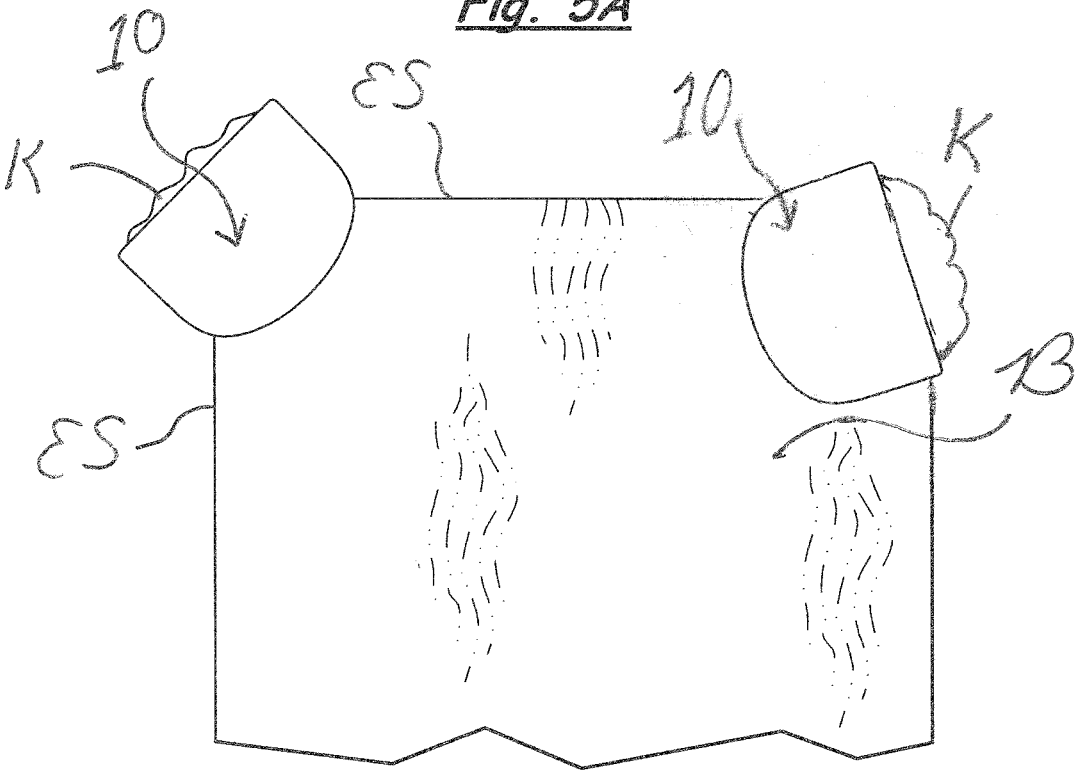
FIG. 5B is a schematic front view of two of the protection device embodiments of FIG. 4 being used by a holder in right and left hands to grasp a martial arts board, wherein the devices and the holder's hands are at the corners of the board at angles greater than in FIG. 5A to the top edge of the board.

It will be understand that one, or more commonly two, holders cooperate to hold a single board/target. The two holders will each grasp opposite edges of the board in their two hands. The device 10 allows the holder's hands to cup and grip the board at any point on or near the board's edge including corners, and at various angles relative to the board edge, as shown in FIGS. 5A and 5B for one holder. The device 10 does not require, and preferably does not include, seating of any flange or other limiting structure against the board's outer perimeter edge surface ES, and the device can be moved inward relative to the edge surface ES, if desired. This flexibility in placement allows the holders the most comfortable and secure grip on the board.

Semi-Rigidity:

Certain embodiments of the device are made of a semi-rigid material that resists collapse/crush from the initial impact force of the strike, including hits, blows, or kicks, yet is somewhat pliable so the breaker's hand/foot will encounter a slightly-yielding surface and be less susceptible to injury. The inventors believe that too-rigid materials may injure the striker and/or may become brittle over time making it more likely to fracture and cause injury to the kicker/striker and/or the holder, while too-flexible materials may allow injury of the holder.

The material employed preferably also incorporates a certain amount of "stickiness" to promote a measure of grip and skid resistance for both the holder's fingers/hand inside the device, as well as that portion of the device's surface that contacts the board. The material preferably also provides some level of elasticity to accommodate varying hand sizes. A variety of materials or mixes may create such properties, with the especially preferred material(s) exhibiting a durometer measurement from about 50 A to about 90 A on the Shore Hardness scale, and more preferably from 65 A to about 85 A. 85 A Shore Hardness is currently the especially-preferred hardness. These ranges of Shore Hardness Scale A, and particularly a hardness equal to, or about, 85 A Shore Hardness are particularly important in certain embodiments, to provide the desired balance between protection of the holder and protection of the kicker/striker. For example, 35 A Shore Hardness in many embodiments has been found by the inventors to be too flexible and soft, while 92 A Shore Hardness in many embodiments has been found by the inventors to be too rigid and hard. Examples of effective materials are thermoplastic elastomers, and especially thermoplastic vulcanizates (TPVs) such as Santoprene™, that are preferably in the 65-85 A Shore Hardness range. The overall outer shape of certain embodiments that use such semi-rigid material(s) as those described herein can be many different geometries, with the preferred embodiment using a rounded, domed, or "flattened dome", such as device 10, to minimize tearing or cutting injuries to the breaker.

Figure 31:
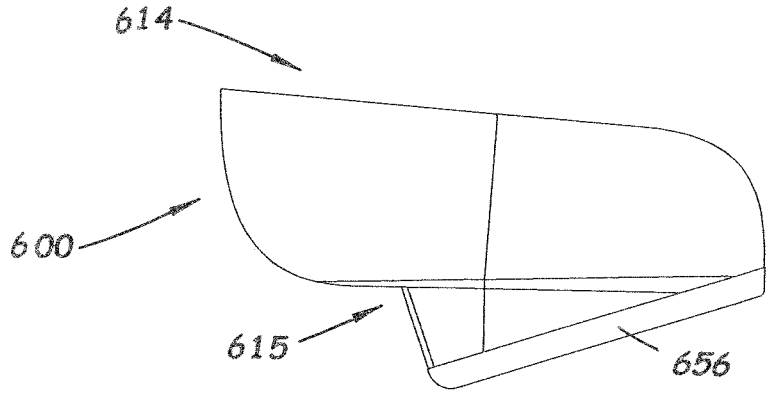
FIG. 31 is a side view of an alternative embodiment of the device having a rear portion adapted for increased gripping capability.
Figure 32:
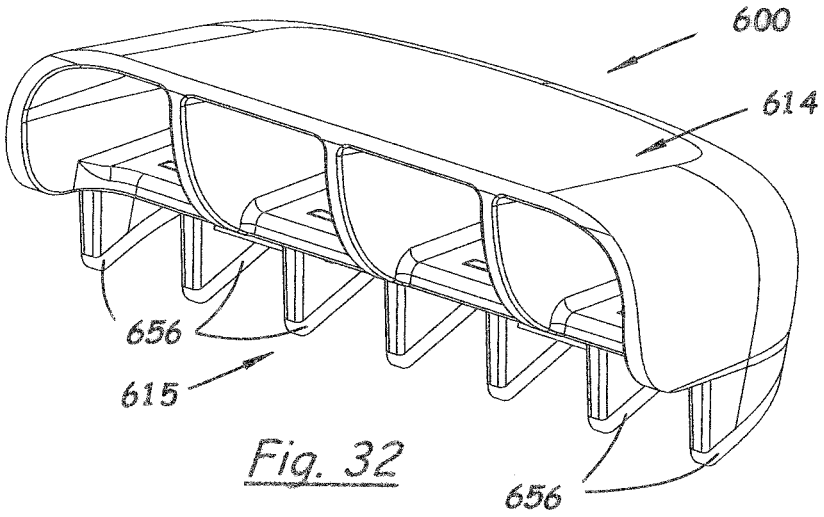
FIG. 32 is a proximal end perspective view of the device of FIG. 31.

Certain embodiments benefit from providing a supplemental or different material, compared to the material(s) of the rest of the device, on the rearward extremities of the rear portion, for improving grip of the device on the front surface of the board. For example, the rearward extremities of the extensions 50, bars 150, pegs 250, walls 350, walls and blocks 450, and continuous-wall blocks 550, and the slanted protrusions from the right- and left-sidewalls (or the "right- and left-sidewall extremities"), and any other structure forming the "slanted rear extremity" may be formed of, or coated with, a softer and better-gripping material compared to the material forming the enclosures and the main portion(s) of said rear portion. FIGS. 31 and 32 illustrate such a device 600, with enclosure 614 and rear portion 615 being of one or more materials with durometer measurement(s) in the range of 65 A-85 A Shore Hardness, but with the rearward extremities 656 being formed of, or less preferably coated with, a softer polymer or other material than the rest of the device, for example, of a softer durometer 30-64 Shore A, or more preferably 30-60 Shore A, and most preferably about 50 Shore A Hardness. These softer portion(s) will grip the board, while the other portions of the device feature the desired semi-rigidity to resists collapse/crush, while not becoming brittle or likely to fracture.

Angled Ergonomic Base:

Certain embodiments of the device use what may be called "an angled base" to support proper hand/wrist position when holding the target, as this is particularly important at the time of impact of the kicker's/striker's foot/hand against the board. This angled base holds the device so that the rear wall/floor of the finger compartment/interior space of the device is at an angle A to the board/target. Given the geometry of a human hand, the angle A of the rear wall/floor encourages the holder to place the heels of their hands nearer to the outer perimeter of the board/target as opposed to the inner or more central region of the board/target. As discussed above, the heel of the user's hand, when using certain embodiments of the invention, may actually be rearwardly-distanced from the rear surface of the board, due to the preferred "rotation" of the hand, as discussed above.

The angled base is provided by the rear portion of the device being specially-adapted to allow, and encourage, use of the device in the desired location and position on the board, as discussed above regarding FIGS. 6A and 6B. The preferred rear portion rests on the front surface/plane FP of the board B, and is not capable of being placed on, or contacting, both the front surface of the board and the outer perimeter edge surface ES of the board. Thus, the preferred rear portion is not usable, or not effectively and reasonably usable, in a location and positon that would diminish the angle A of the floor to the front plane FP of the board B. For example, the rear portion is adapted so that the device is not usable in a location and position that would reduce angle A below 5 degrees (when the preferred range is 5-45 degrees), reduce angle A below 10 degrees (when the preferred range is 10-25 degrees), reduce angle A below 16 degrees (when the preferred range is 16-20 degrees), or reduce angle A below 18 degrees (when the preferred angle is 18 degrees).

Said specially-adapted rear portion comprises structure that protrudes rearward relative-to the slanted floor of the device. The preferred structure has rearward extremity(ies) located and spaced so that said structure holds the floor at the desired slant relative to the board, without it being possible, or at least without it being likely, for the device to be used in a position where some of said structure is contacting the front surface of the board and some of said structure is contacting the outer perimeter edge surface of the board. A preferred example is the rearward extension system of device 10 comprising triangular rearwardly-protruding extensions 50 with rearward extremities/edges 56. These extensions 50 extend all or nearly all along the length of the floor 20, between the distal extremity 22 of the floor 20 (at or near closed end 32), and the opposite, proximal extremity 24 of the floor 20 (nearer the opening 34). The rearmost extremities/edge 56 of the triangular extensions 50, all along the length of the extensions 50, rest on the front surface/plane FP of the board, preventing the device from pivoting to diminish angle A, and thus preventing the floor from becoming parallel to the front surface/plane FP of the board. Extensions 50 are semi-rigid, as discussed earlier in this document, and the rearmost extremities/edges 56 are straight/linear. Therefore, the extensions 50 will not flex or compress to an extent that would allow the device to be "pivoted around the corner" to place portions of the extensions 50 both on the front surface and on the outer perimeter edge surface of the board. Thus, proper placement and use on the front surface of the board is required of at least encouraged by the structure of the device.

Said specially-adapted rear portion may comprise a rearward extension system of other forms/shapes, for resting on the front surface/plane FP of the board/target and place the rear wall/floor at the desired angle A. The rear portion may comprise other arrangements and numbers of plates, protrusions, or other supporting structure, for example, a single or a plurality of solid or hollow structures having a rearward extremity(ies) that contact the board/target sufficiently to stabilize the device against the front surface of the board/target. For example, instead of or in addition to the multiple parallel triangular walls 50, pyramids, pillars, bars, blocks, pegs, posts, straight walls, curved walls, other such geometric shapes such as honeycombed cells, and any combination of these shapes/structures, including hollow, partially hollow, and solid, may be used. The extensions may be fixed to or integral with the floor of the device, at multiple locations between, or extending substantially the entire distance between, the proximal extremity and the distal extremity of the floor. Some of the extensions, and/or some portions of the extension(s), are located on each of the right and left sides of the longitudinal central axis LA ("length axis") of the floor, and on each of the distal and proximal sides of the transverse central axis WA ("width axis") of the floor. It will be understood that "portions" in this context result from extensions extending across the axis LA, and/or the axis WA. Hence, it may be said that an extension has a portion, or extensions have portions, on both right and left sides of the axis LA, and/or both the proximal and distal sides of the axis WA. The extensions preferably extend, or are arranged, generally symmetrically on each side of the longitudinal central axis LA of the floor and on each side of the transverse central axis WA of the floor, for increasing contact surface area between the device and the board, increasing stability of the device on the board, and benefitting load transfer. The longitudinal central axis LA is half way between the right and left sides of the floor 20, and the transverse central axis WA is half way between the distal extremity 22 and the proximal extremity 24 of the floor. See FIGS. 9, 16, 19, 22, 25, and 28.

Figure 8:
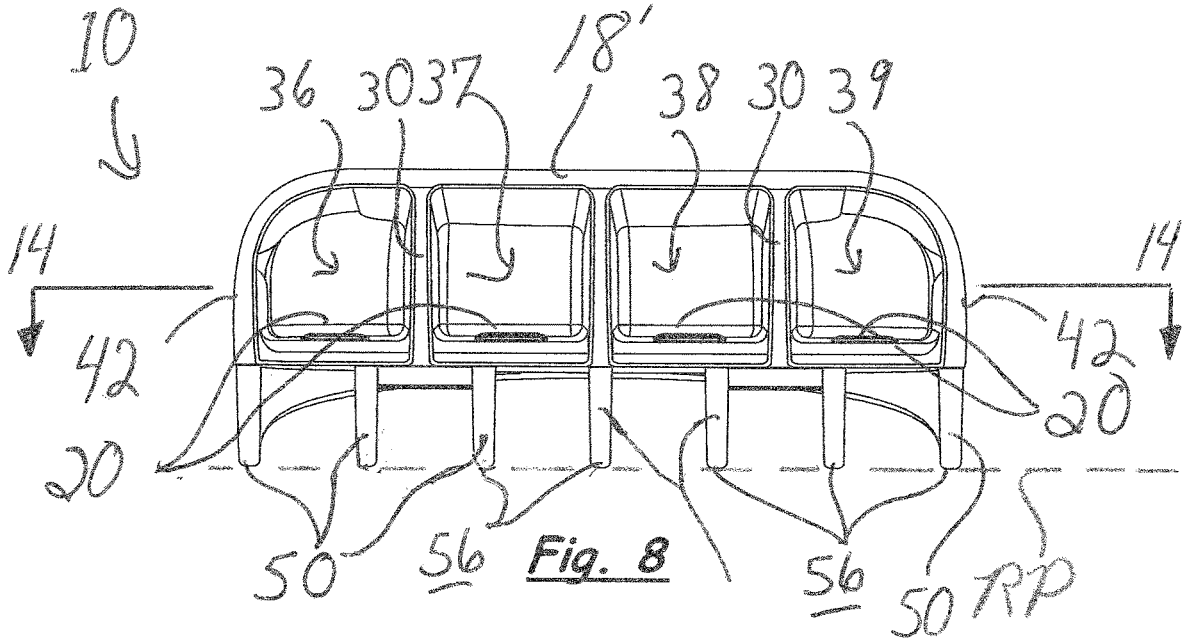
FIG. 8 is an proximal view of the device of FIG. 4, wherein the width of the device is between right and left of the figure.
Figure 9:
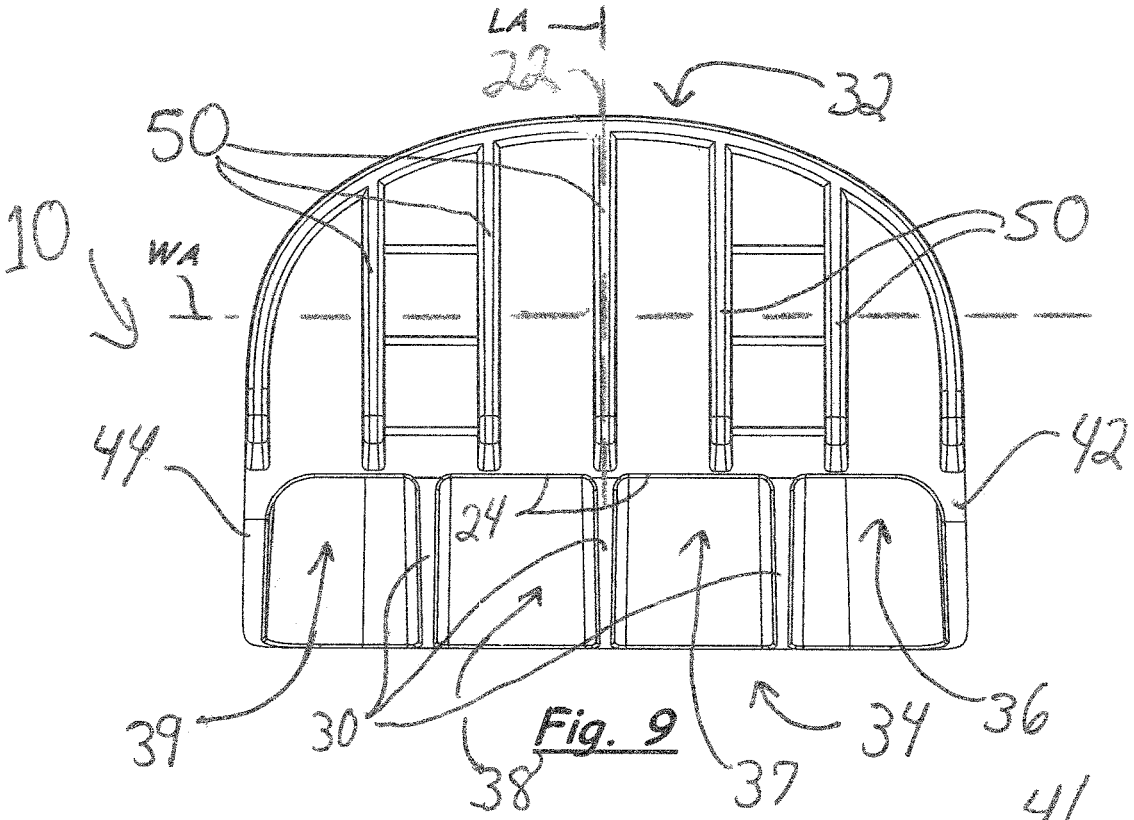
FIG. 9 is a bottom view of the device of FIG. 4, wherein the length of the device is between top and bottom of the figure.
Figure 10:
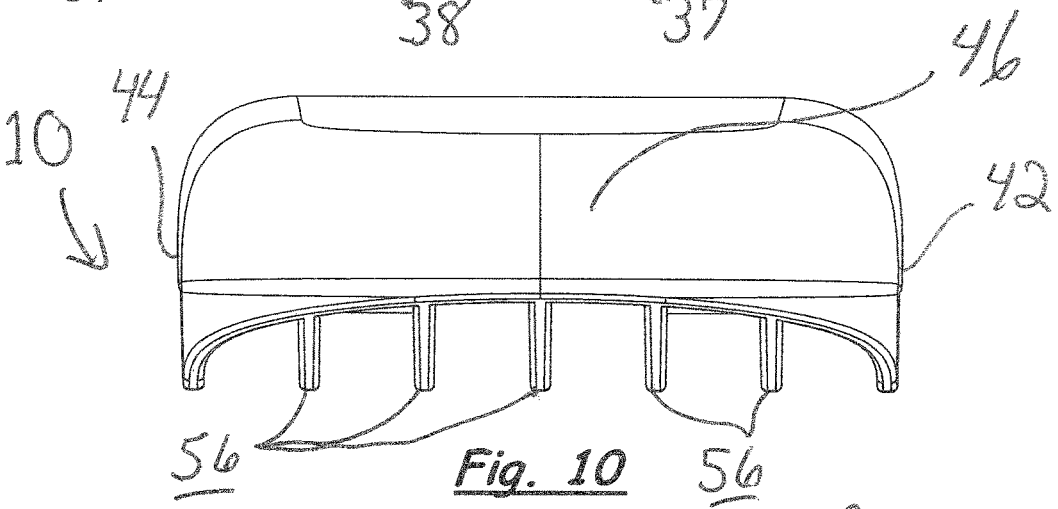
FIG. 10 is a perspective distal end view of the device of FIG. 4, that is, viewing the device as it is oriented in FIG. 11 from the right of FIG. 11.

The rearward extremities of structure/protrusions forming the angled ergonomic base may comprise extensions of the wall(s) that form the enclosure 14. For example, as noted above, the rear portion of device 10 comprises far-right and far-left extensions 50 that extend from the sidewalls 42, 44, in addition to the five more-centrally-located extensions 50, as shown in FIG. 8. Certain embodiments may have a rear portion that only includes extensions at the far right and far-left, extending from the sidewalls 42, 44 for example, but it is preferred that extensions be provided centrally as well, to strengthen the rear portion and make it more reliable and durable.

Figure 16:
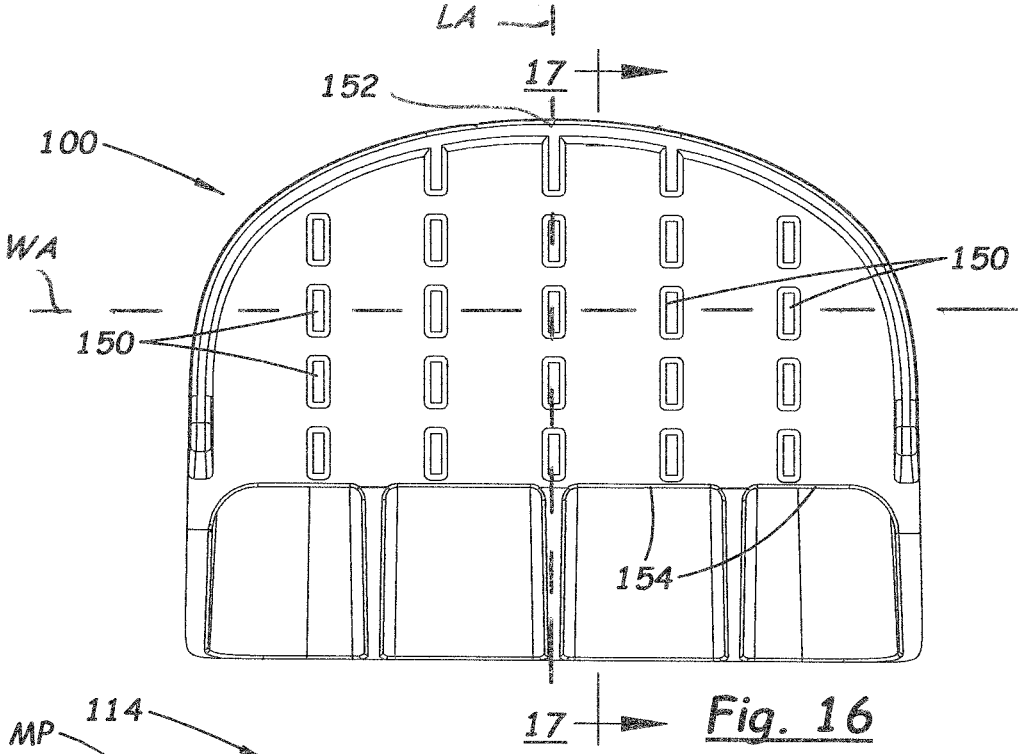
FIG. 16 is a bottom view of a device according to an alternative embodiment of the invention.
Figure 17:
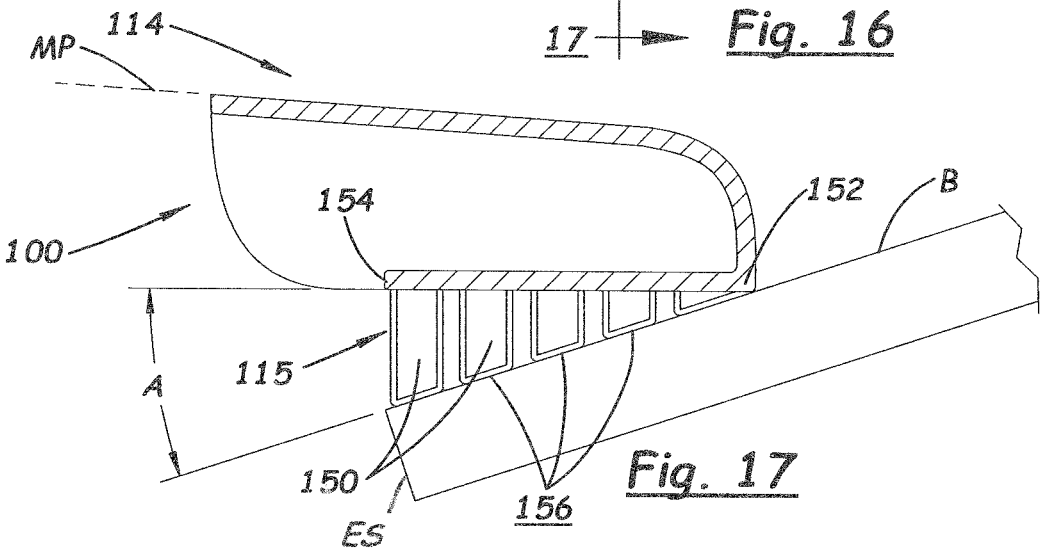
FIG. 17 is a cross-sectional view of the device of FIG. 16 on a martial arts board.
Figure 18:
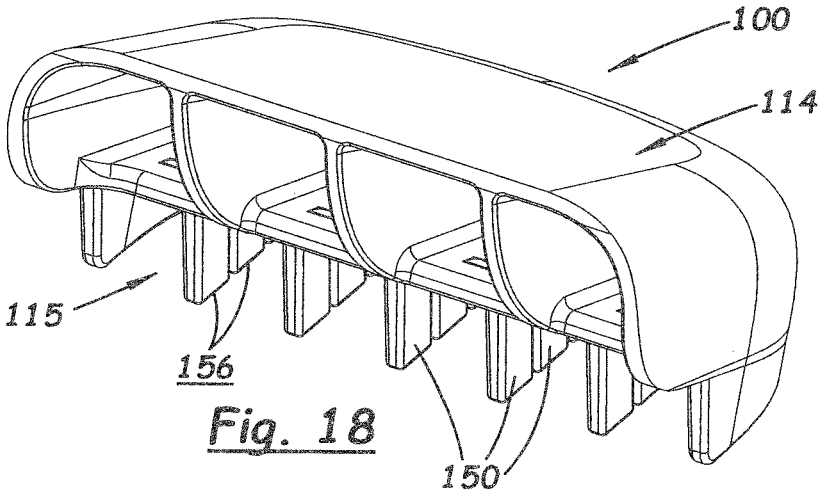
FIG. 18 is a proximal end perspective view of the device of FIGS. 16 and 17.

FIGS. 16-18 feature a device 100 with enclosure 114 and a rear portion 115 that comprises rectangular bars 150, the rearward extremities 156 of which preferably all lie on the rear plane of the device for contacting the front surface of the board B. As shown in FIG. 16, the bars 150 are provided in five columns parallel to the length of the device, and extending along a substantial amount of the length of the floor between the distal extremity 152 and the proximal extremity 154. The bars 150 are spaced-apart in rows that extend along a substantial amount of the width of the device 100. Each row of bars extends a different distance from the floor ("bar length"), and each rearward extremity 156 is preferably slanted relative to the length of the bar to be at angle A relative to the floor, as seen in FIG. 17, so that a substantial surface area of the bar lies on the single rear plane. This results in the slanted extremities 156, and preferably the slanted protrusions from the right- and left-sidewalls (or the "right- and left-sidewall extremities"), forming the "slanted rear extremity" that rests on the front surface/plane FP of the board/target to place the rear wall/floor at the desired angle A. The relationships of the components of device 100, for example, the main plane MP of the front wall of the enclosure 114 relative to the rear plane of the device, and the floor to the rear plane and the front plane of the board, are preferably structured as discussed above regarding device 10.

Figure 19:
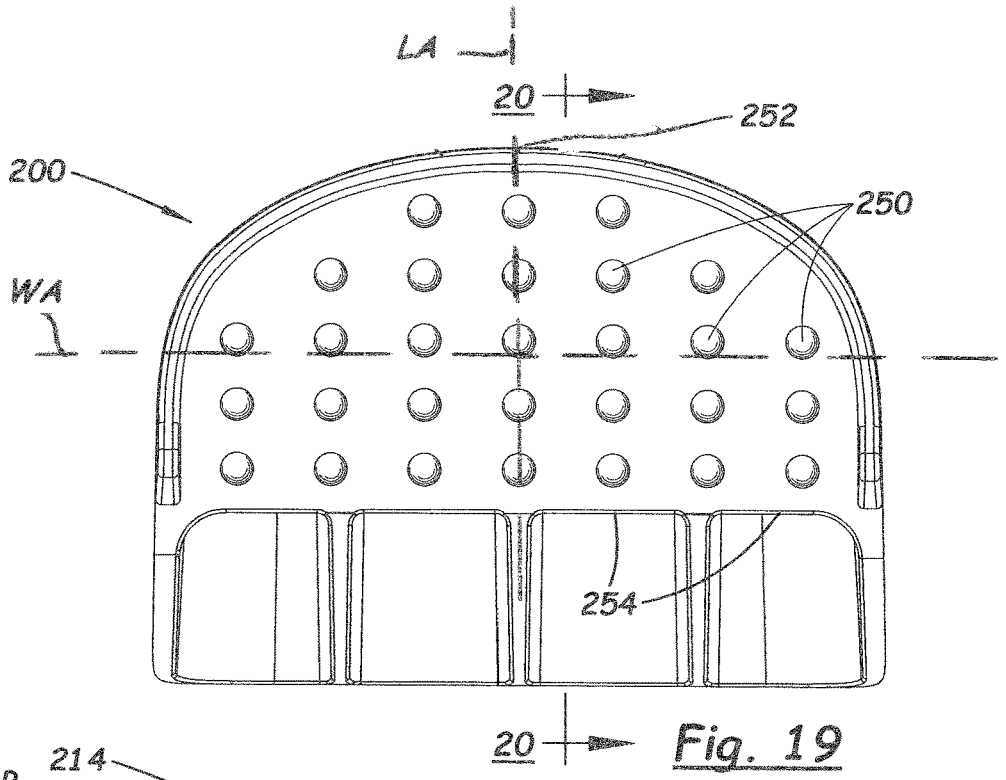
FIG. 19 is a bottom view of another embodiment of the invented device.
Figure 20:
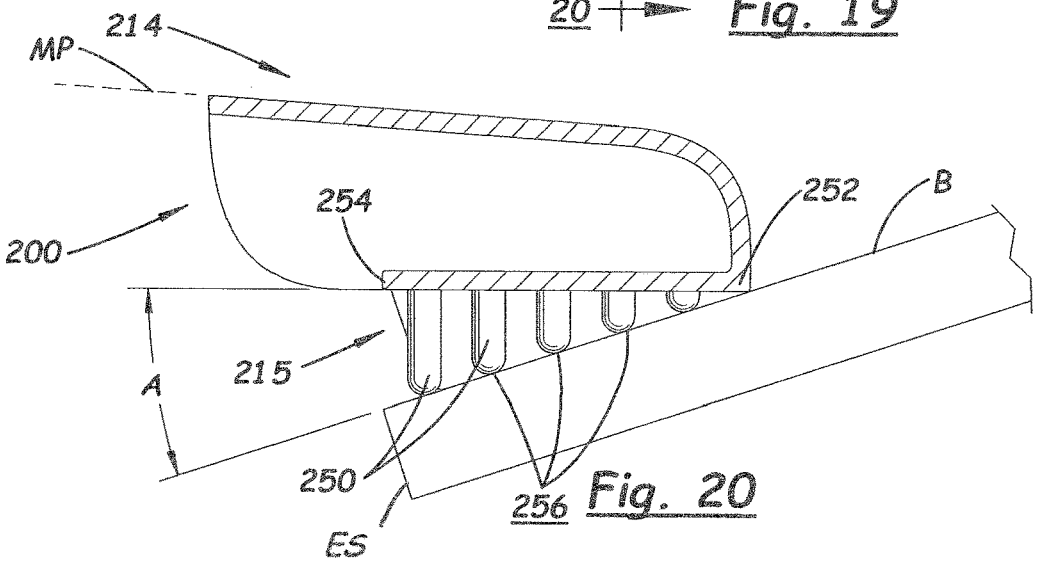
FIG. 20 is a cross-sectional view of the device of FIG. 19 on a martial arts board.
Figure 21:
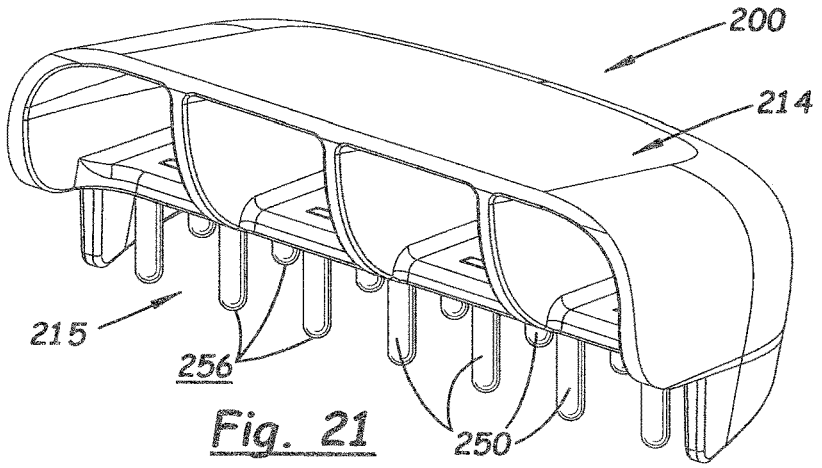
FIG. 21 is a proximal end perspective view of the device of FIGS. 19 and 20.

FIGS. 19-21 feature a device 200 with enclosure 214 and a rear portion 215 that comprises pegs 250, the rearward extremities 256 of which preferably all lie on the rear plane of the device for contacting the front surface of the board B. As shown in FIG. 19, the pegs 250 are provided in seven columns parallel to the length of the floor and extending along a substantial amount of the length of the device between the distal extremity 252 and the proximal extremity 254. The pegs 250 are spaced-apart in rows that extend across a substantial amount of the width of the device 200. Each row of pegs extends a different distance from the floor, that is, each row of pegs features a "peg length", between the first ends of the pegs connected to the floor and the rear ends of the pegs, that is different from that of the other rows. Preferably every peg in a given row has the same peg length. This way, each row of pegs has a different "peg length" to lie on the slanted single rear plane. At least a portion of each rounded peg end rests on the front surface of the board B, as may be seen in FIG. 20. This results in the extremities 256, and preferably the slanted protrusions from the right- and left-sidewalls, forming the "slanted rear extremity" that rests on the front surface/plane FP of the board/target to place the rear wall/floor at the desired angle A. The relationships of the components of device 200, for example, the main plane MP of the front wall of the enclosure 214 relative to the rear plane of the device, and the floor to the rear plane and the front plane of the board, are preferably structured as discussed above regarding device 10.

Figure 22:
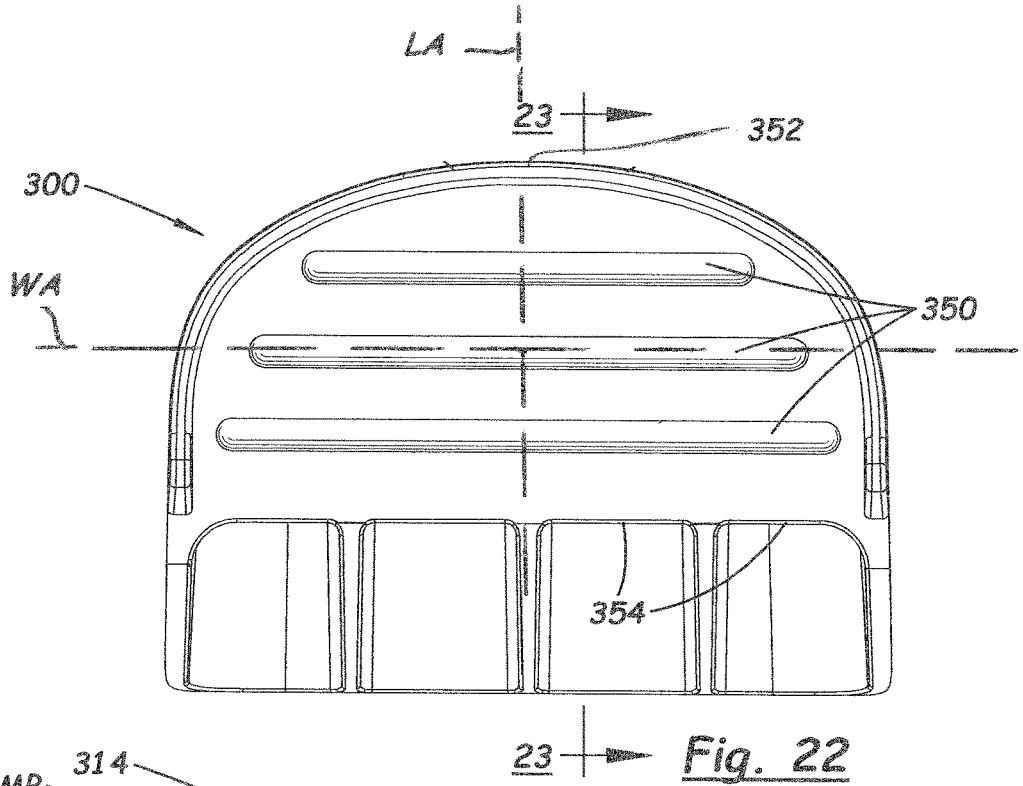
FIG. 22 is a bottom view of another embodiment of the invented device.
Figure 23:
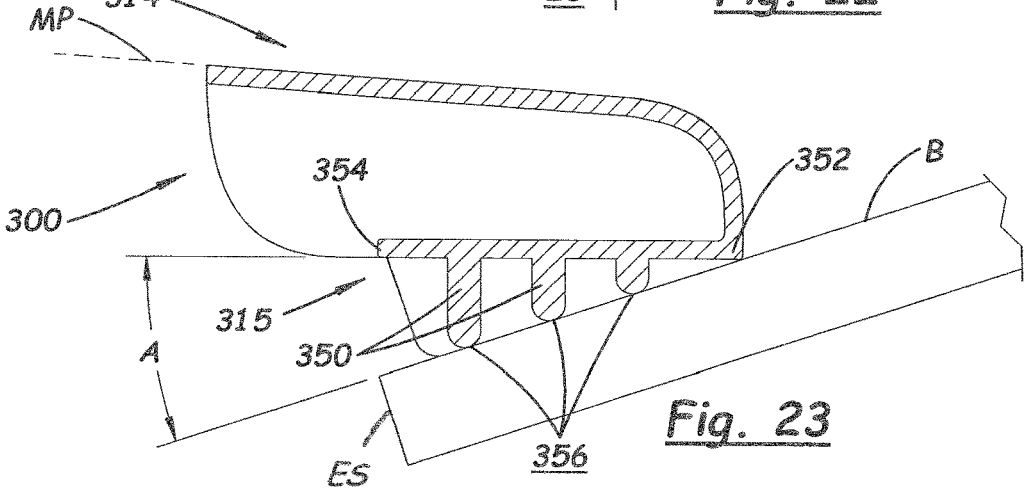
FIG. 23 is a cross-sectional view of the device of FIG. 22 on a martial arts board.
Figure 24:
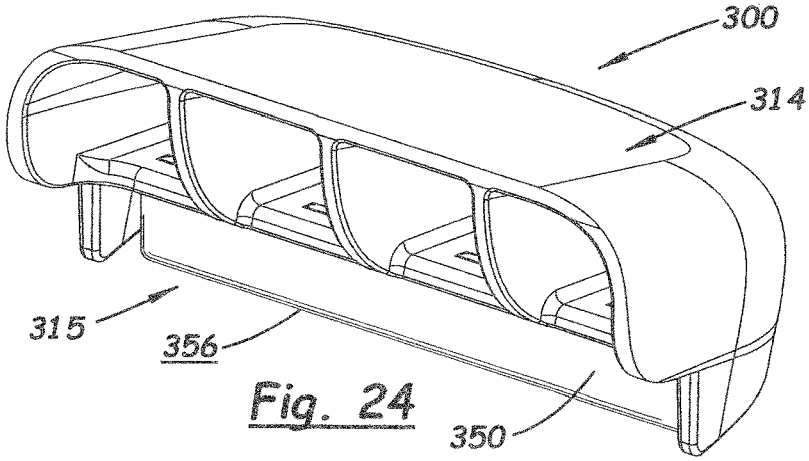
FIG. 24 is a proximal end perspective view of the device of FIGS. 22 and 23.

FIGS. 22-24 feature a device 300 with enclosure 314 and a rear portion 315 that comprises walls 350 parallel to the width of the device, the rearward extremities 356 of which preferably all lie on the rear plane of the device for contacting the front surface of the board B. As shown in FIG. 22, each wall extend along a substantial amount of the width of the device. Also, as shown in FIG. 22, the walls 350 are spaced-apart along a substantial amount of the length of the floor, so that one wall 350 is at or near to the distal extremity 352 and one wall 350 is at or near the proximal extremity 354, and one wall 350 is in between the distal and proximal walls. Each wall 350 extends a different distance from the floor, so each wall has a different "wall length" between its first end connected to the floor and its rear end, for lying on the slanted single rear plane. At least a portion of the rounded rearward extremity 356 of each wall rests on the front surface of the board B, as may be seen in FIG. 23. This results in the extremities 356, and preferably the slanted protrusions from the right- and left-sidewalls, forming the "slanted rear extremity" that rests on the front surface/plane FP of the board/target to place the rear wall/floor at the desired angle A. The relationships of the components of device 300, for example, the main plane MP of the front wall of the enclosure 314 relative to the rear plane of the device, and the floor to the rear plane and the front plane of the board, are preferably structured as discussed above regarding device 10.

Figure 25:
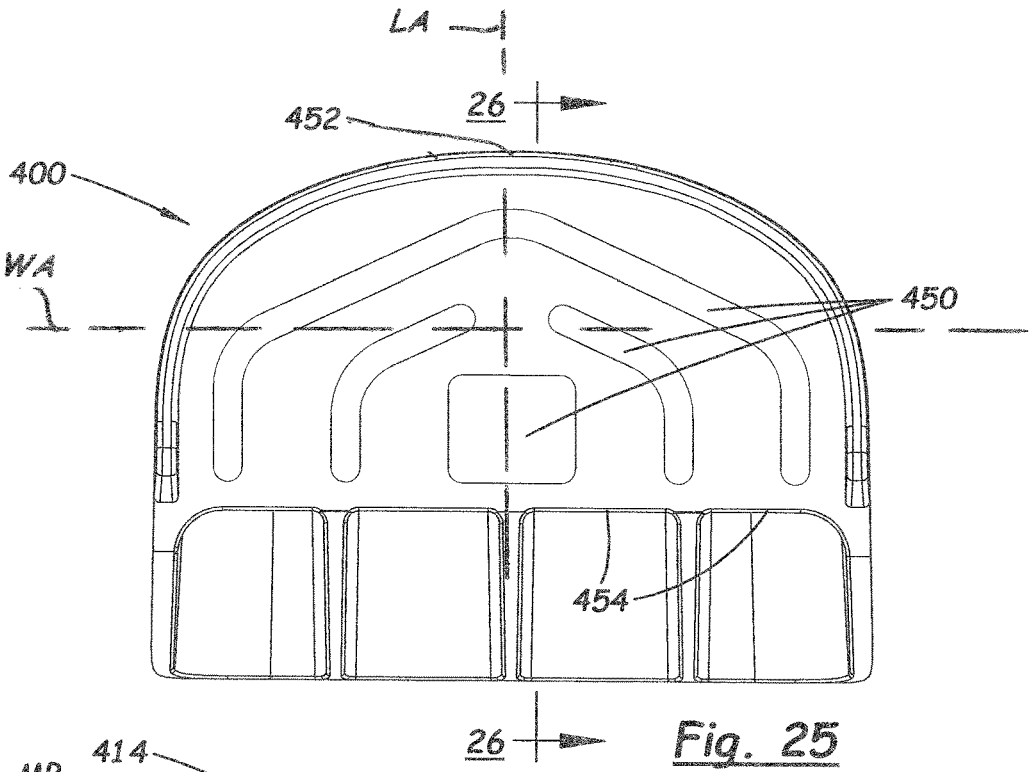
FIG. 25 is a bottom view of another embodiment of the invented device.
Figure 26:
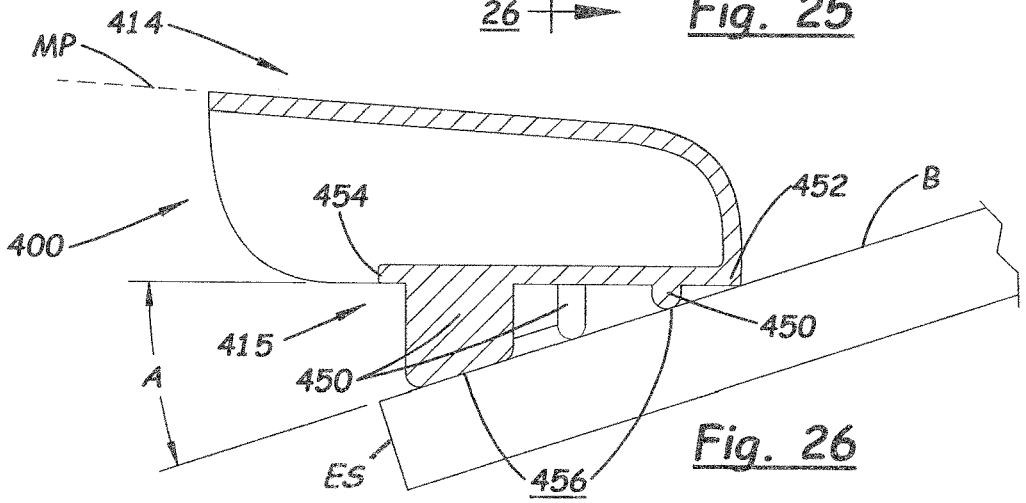
FIG. 26 is a cross-sectional view of the device of FIG. 25 on a martial arts board.
Figure 27:
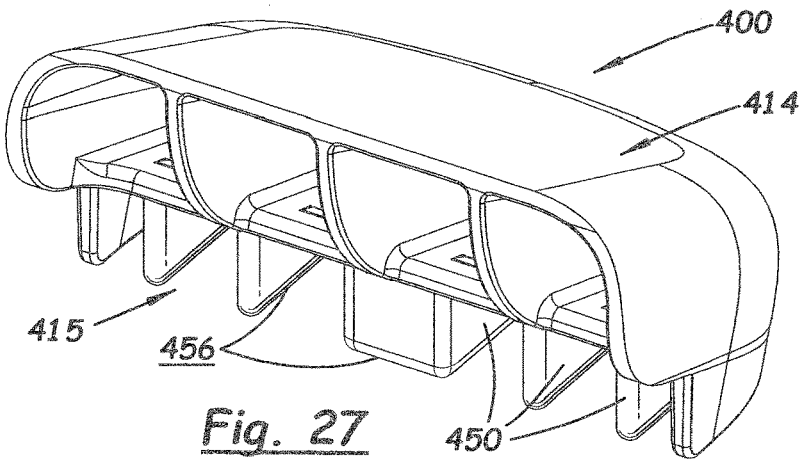
FIG. 27 is a proximal end perspective view of the device of FIGS. 25 and 26.

FIG. 25-27 feature a device 400 with enclosure 414 and a rear portion 415 that comprises three walls and a square block (collectively 450), the rearward extremities 456 of which preferably all lie on the rear plane of the device for contacting the front surface of the board B. As shown in FIG. 26, the walls and block 450 are spaced-apart along a substantial amount of the length of the floor (from at or near the distal extremity 452 to at or near the proximal extremity 454 of the floor), and along a substantial amount of the width of the device 400 (from at or near the left side to at or near the right side, in FIG. 25). At least a portion of the rounded rearward extremity of each wall, and the slanted rearward extremity of the square block, rest on the front surface of the board B, as may be seen in FIG. 26. The rear end of the square block is preferably slanted to be at angle A relative to the floor, as seen in FIG. 26, so that a substantial surface area of the square block lies on the slanted single rear plane. This results in the extremities 456, and preferably the slanted protrusions from the right- and left-sidewalls, forming the "slanted rear extremity" that rests on the front surface/plane FP of the board/target to place the rear wall/floor at the desired angle A. The relationships of the components of device 400, for example, the main plane MP of the front wall of the enclosure 414 relative to the rear plane of the device, and the floor to the rear plane and the front plane of the board, are preferably structured as discussed above regarding device 10.

Figure 28:
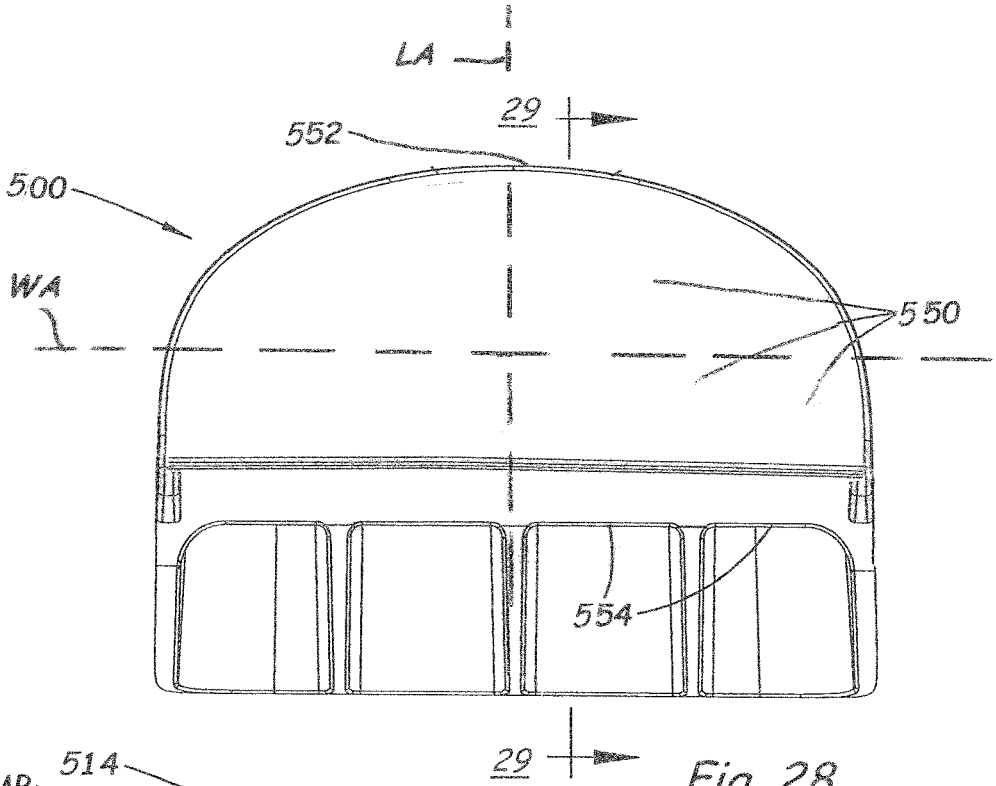
FIG. 28 is bottom view of another embodiment of the invented device.
Figure 29:
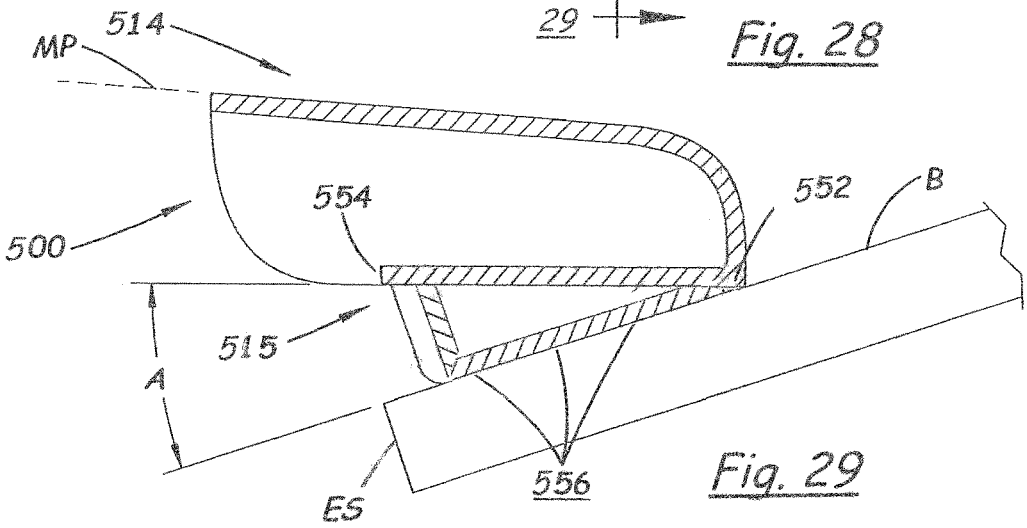
FIG. 29 is a cross-sectional view of the device of FIG. 28 on a martial arts board.
Figure 30:
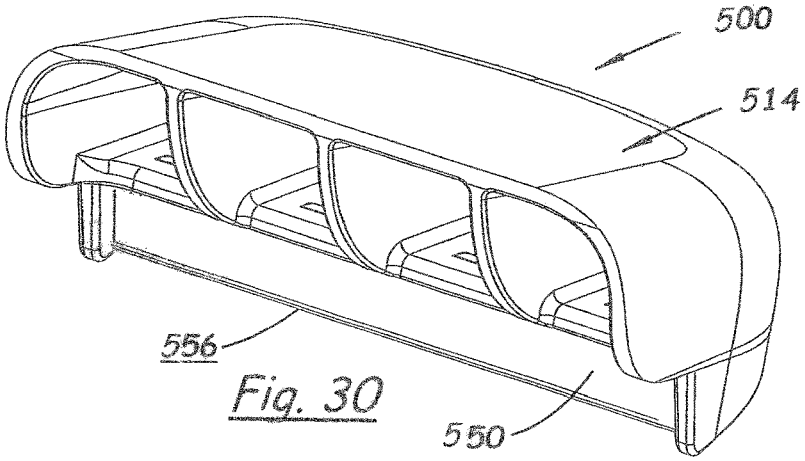
FIG. 30 is a proximal end perspective view of the device of FIGS. 28 and 29.

FIGS. 28-30 feature a device 500 with enclosure 514 and a rear portion 515 that comprises a single extension or single "block" 550, the rearward extremity 556 of which is a continuous longitudinally-slanted wall on the rear plane of the device for contacting the front surface of the board B. As shown in FIG. 29, the single extension 550 extends along a substantial amount of the length of the floor (from at or near the distal extremity 552 to at or near the proximal extremity 554 of the floor, and along a substantial amount of the width of the device 500. The rearward extremity 556 rests on the front surface of the board B, as may be seen in FIG. 29. This results in the extremity 556, and preferably the slanted protrusions from the right- and left-sidewalls, forming the "slanted rear extremity" that rests on the front surface/plane FP of the board/target to place the rear wall/floor at the desired angle A. The relationships of the components of device 500, for example, the main plane MP of the front wall of the enclosure 514 relative to the rear plane of the device, and the floor to the rear plane and the front plane of the board, are preferably structured as discussed above regarding device 10.

Extension 550 is an example of a hollow block/structure protruding from the floor and having a slanted continuous rear wall, wherein the slant relative to the floor provides the desired angle A. Alternatively, extension/block 550 may be solid rather than hollow. Thus, it will be understood that certain embodiments have a continuous, rearward extremity wall surface extending all or substantially all along the length of the floor and the width of the floor, and such an extension/block may be hollow, partially hollow, or solid. Compared to these "continuous-rearward-extremity-wall" embodiments, however, embodiments that include multiple, spaced-apart protrusions (such as triangular walls, pyramids, pillars, bars, blocks, pegs, posts, straight walls, curved walls, other such geometric shapes such as honeycombed cells, etc.) are preferred because they may be beneficial for polymer molding methods of manufacture of the device.

Figure 2B:
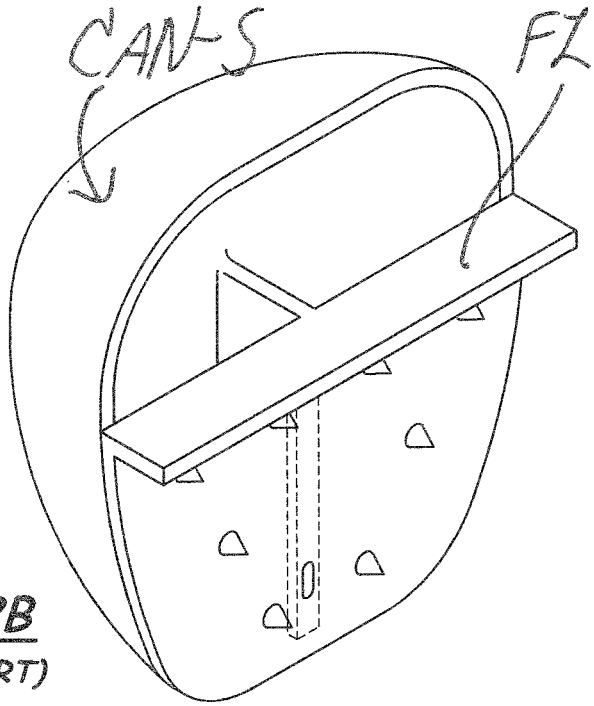
Fig. 2B (PRIOR ART)
FIG. 2B is a rear perspective view of the prior art sheath of FIG. 2A.
Figure 3A:
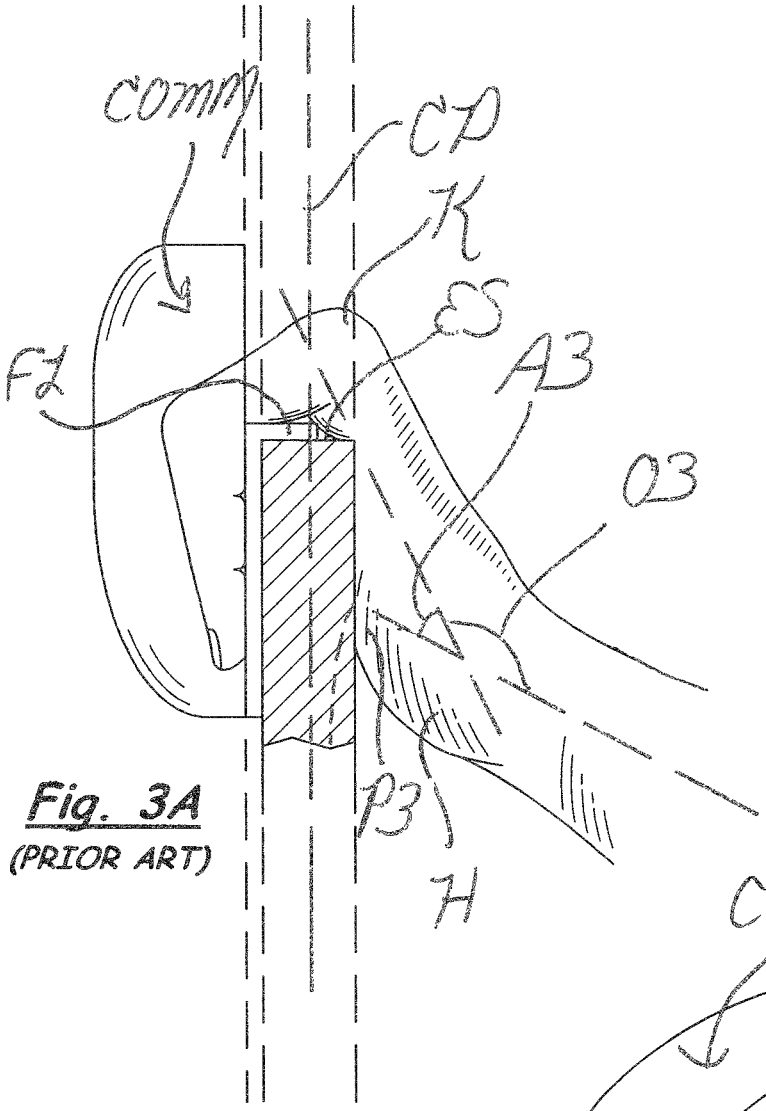
Fig. 3A (PRIOR ART)
FIG. 3A is a side view of a holder using a prior art commercial sheath similar to that disclosed in Canella, U.S. Pat. No. 4,807,302, to grasp a martial arts board, resulting in the hand being rotated clockwise in this figure.
Figure 3B:
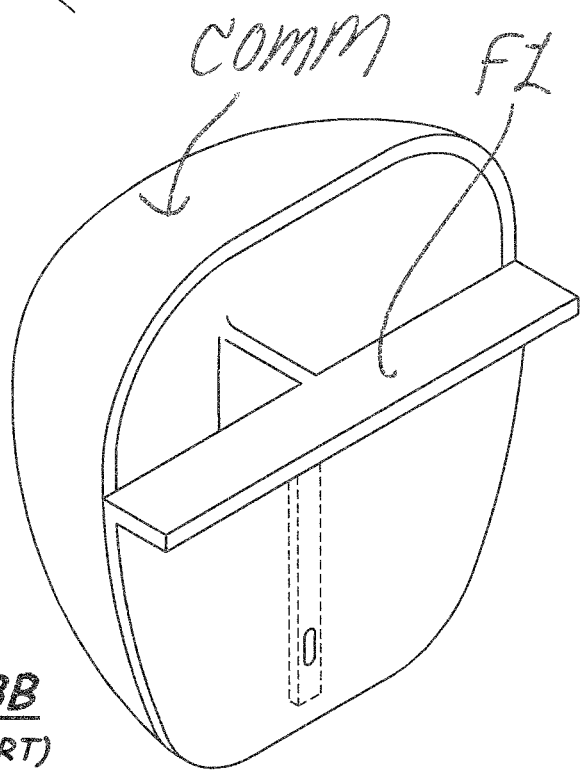
Fig. 3B (PRIOR ART)
FIG. 3B is a rear perspective view of the prior art commercial sheath of FIG. 3A.

It may be noted that the preferred rear portion/extension system of the invention is different in structure and function compared to the single flange FL, or the flange FL combined with the spikes 14, of the Cannella devices of FIGS. 2B and 3A and B. The flange FL and the spikes 14 do not have rearmost extremities all on the same plane, and so the spikes 14 contact the front surface of the board, while the flange FL contacts the outer perimeter edge surface ES of the board. If the Canella flange FL were placed on the front surface, the spikes 14 would not contact the front surface. Therefore, the flange and spikes could not work in combination to hold the floor at an angle to the board, and placing the Canella flange on the front surface of the board would be counter to its intended use and function.

Load Transference:

The interior space of the device is preferably divided into multiple sections/portions. The device may use single or multiple dividers equally or unequally spaced across the compartment. Those dividers may be parallel with the device's sidewalls, or may employ a non-parallel orientation such as in a radiating fan shape. In the preferred configuration, the finger compartment is divided into four sections, with three dividers providing load support to transfer the breaker's force from the device's top/outer plate (the frontmost extremity of the front wall) to the rear wall/floor and then to the rear portion/extensions of the device that are in contact with the board. Such dividers also provide a gripping surface for the holder's fingers. The divider(s) may be curved at their proximal edges 31, as in device 10, to minimize the chance of pinching or scissoring the holder's fingers against the board surface.

It may be noted from the drawings, that the center divider 30 of device 10 is coplanar with the central extension 50 and that the sidewalls (sidewall portions 42, 44) are coplanar with the outermost extensions 50. These features may enhance load transference in certain embodiments. It may also be noted that the other dividers, that is, the dividers directly adjacent to center divider are parallel but not coplanar with any extensions. Thus, it may be said that some of the dividers 30 are co-planar with the extensions 50 while some are not. Alternatively, the dividers may be other shapes and arrangements in certain embodiments. Each divider may be solid, planar, and continuous, such as shown in device 10, to maximize support and load transference, or alternatively may employ one or more holes, openings, ribs or reinforcements, for appearance and/or to enhance the divider's role in transferring the force through the device to the board and/or otherwise protecting the user's hand. It may also be notes that the extensions 50 may be other shapes than those drawn, for example, arches.

Figure 14:
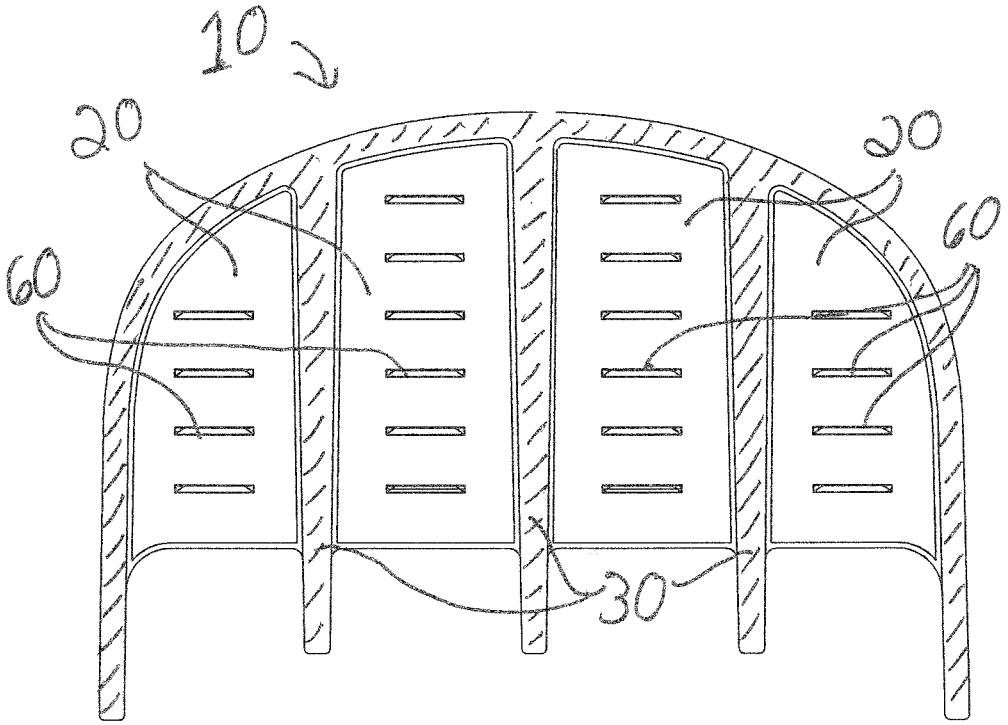
FIG. 14 is a cross-sectional view of the device of FIG. 4, viewed along the line 14-14 in FIG. 8.
Figure 15:
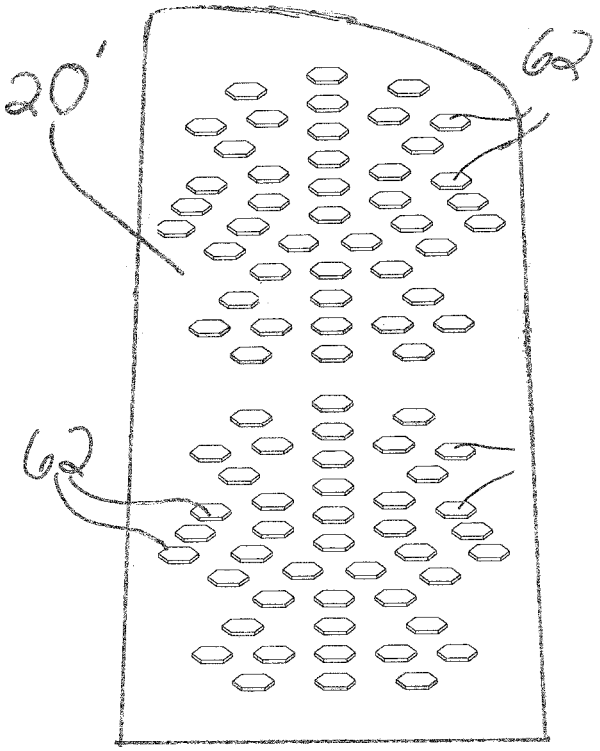
FIG. 15 is a partial view of an alternative floor wall, specifically a section of a floor wall between two dividers, showing an alternative texture embodiment.

The device's floor 20 may be either smooth or feature raised protrusions or other texture to enhance grip and inhibit slip. As illustrated in FIG. 14, certain embodiments use elongated ribs 60 that extend transversely to the dividers 30, which ribs have been found to be excellent structures for the fingertips to engage/grip. Alternatively, ribs in a chevron or herringbone pattern, for example, may be excellent engagement/gripping structures. Other protrusions/texture may be used in certain embodiments, for example, geometric shapes such as hemispherical domes, protruding squares, or protruding hexagonal piers 62 such as those portrayed on alternative floor portion 20' in FIG. 15. Alternatively, the device may have texturing (like a roughened or bead-blasted surface, gunstock checkering or cross-hatching) on selected areas to improve the user's grip on the device, or more typically, the device's grip on the board. This texturing can also be added in other areas of the device for aesthetics and appearance or styling.

It should be noted that the terms "front" and "rear" are for convenience in describing various aspects of the protector device and are not necessarily intended to limit the use of the protector device to particular orientations.

Certain embodiments may be described as a protection device for use by a user grasping a martial arts board, the device comprising: an enclosure surrounding and defining an interior space, the enclosure having a front wall for receiving an impact from a martial arts striker (those impacting the board with hand, foot, or any body part) an opposing rear wall, and an open end for receiving distal portions of the fingers of the user in the interior space between the front wall and the rear wall so that the distal portions of the fingers push on the rear wall for grasping the board between the device and the palm of the user's hand; and the device further comprising at least one extension member extending from the enclosure and comprising a rearmost extremity for resting on a front surface of the martial arts board, said rearmost extremity being on, and defining, a rear plane parallel to the front surface of the board; wherein said rear wall is at an angle to said rear plane so that the fingers are at an angle to the front surface of the board. The at least one extension member may comprise a triangular wall perpendicular to the rear wall and having a rearmost edge that is the rearmost extremity on the rear plane. Or, the at least one extension member may comprise multiple, parallel triangular walls that are perpendicular to the rear wall and that each have a rearmost edge on the rear plane. The angle of the rear wall to the rear plane may be in the range of 5-45 degrees, for example, but more preferably is in the range of 16-20 degrees, and most preferably about 18 degrees for example, 17-19 degrees. The interior space is preferably divided into four sub-compartments by three dividing walls that are perpendicular to the rear wall, the four sub-compartments being for receiving four of said fingers. The front wall, the entire enclosure, or the entire protective device may be material characterized by having a Shore Hardness in the range of 65 A to 90 A, or more preferably about 85 A, for example. The front wall may have a planar main portion that is at an angle to the rear wall. The device may include no structure that extends rearward from said rear plane, for example, to enhance the options for placement on the board.

Certain embodiments may be described as a system for use in martial arts striking competition or practice, the system comprising a martial arts board having a front surface and a rear surface and an outer perimeter edge; and a finger protective device comprising: an enclosure surrounding and defining an interior space, the enclosure having a front wall for receiving an impact from a martial arts striker, an opposing rear wall, and an open end for receiving the user's fingers into the interior space; and at least one extension member extending rearward from the enclosure and comprising a rearmost extremity defining a rear plane, wherein the rearmost extremity is placed on the front surface of the board at or near the outer perimeter edge, with the rear plane being parallel to the front surface of the board, for the user to grasp the board between the device and the palm of the user's hand placed behind the board; wherein said rear wall is at an angle in the range of 5-45 degrees to said rear plane, so that the user's fingers resting on the rear wall are at an angle to the rear plane and to the front surface of the board; and wherein at least said enclosure is made of material having a Shore Hardness in the range of 65 A to 90 A. The angle of the rear wall to the rear plane may be in the range 16-20 degrees, or more preferably about 18 degrees, for example. The at least one extension member may comprise multiple, parallel triangular walls that are perpendicular to the rear wall and that each have a rearmost edge on the rear plane. The interior space may be divided into four sub-compartments by three dividing walls that are perpendicular to the rear wall, the four sub-compartments being for receiving four of said fingers. In certain embodiments, the front wall, the entire enclosure, or the entire protective device may be made from material characterized by having a Shore Hardness in the range of about 65 A to 90 A, for example, or more preferably about 85 A. The front wall may have a planar main portion that is at an angle to the rear wall. In certain embodiments, the device comprises no structure that extends rearward from said rear plane, to enhance the options for placement of the device on the board.

Certain embodiments may be described as a finger protector for holding a martial arts board, the protector being adapted for receiving distal portions of fingers of a user, and the protector comprising a front wall for receiving an impact from a striker of the board, a rear wall for being pressed-on by the fingers or fingertips of said fingers, and a rear portion for resting on the martial arts board, wherein the rear wall is at an angle, to the rearmost plane of the rear portion and also to the front surface of the board, in the range of 5-45 degrees, to cause the user's hand to rotate forward relative to the board when grasping the board between the device and the user's palm, for placing the user's hand and wrist in an improved ergonomic position for increased safety. The finger protector may be made of material characterized by having a Shore Hardness in the range of 65 A to 90 A, for example, or most preferably about 85 A. In certain embodiments, the device comprises no structure that extends rearward from said rear plane, to enhance the options for placement of the device on the board.

Certain embodiments may be described as a protection device for use by a user grasping a martial arts board, the device comprising: an enclosure surrounding and defining an interior space, the enclosure having a front wall for receiving an impact from a martial arts striker, an opposing slanted floor, and an open end for receiving distal portions of the fingers of the user in the interior space between the front wall and the slanted floor, so that the distal portions of the fingers push on the slanted floor for grasping the board between the device and the palm of the user's hand; the slanted floor having a proximal extremity near the open end and an opposing distal extremity, a longitudinal central axis between the proximal and distal extremities, and a transverse central axis perpendicular to the longitudinal central axis and half way between said proximal and distal extremities; the device further comprising a plurality of extension members that extend rearward from the enclosure, wherein at least a portion of multiple of the extension members are proximal of said transverse central axis and comprise a rearmost extremity on, and defining, a single rear plane parallel to the front surface of the board; and at least a portion of multiple of the extension members are distal of said transverse central axis and comprise a rearmost extremity on, and defining, the single rear plane, the rearmost extremities being for resting only on a front surface of the martial arts board; wherein said slanted floor is at an angle to said rear plane so that the fingers are at an angle to the front surface of the board. For example, said at least a portion of multiple of the extension members being proximal of said transverse central axis and comprising a rearmost extremity on, and defining, a single rear plane parallel to the front surface of the board, may result from these extension members being entirely proximal of the transverse central axis, or from these extension members extending across (straddling) said transverse central axis. For example, said at least a portion of multiple of the extension members being distal of said transverse central axis and comprising a rearmost extremity on, and defining, a single rear plane parallel to the front surface of the board, may result from these extension members being entirely distal of the transverse central axis, or from these extension members extending across (straddling) said transverse central axis.

Certain embodiments may be described as a system for use in martial arts striking competition or practice, the system comprising: a martial arts board having a front surface and a rear surface and an outer perimeter edge surface; and a finger protective device comprising: an enclosure surrounding and defining an interior space, the enclosure having a front wall for receiving an impact from a martial arts striker, an opposing slanted floor, and an open end for receiving a user's fingers into the interior space; and at least one extension member extending rearward from the enclosure and comprising a rearmost extremity defining a rear plane, wherein the rearmost extremity is placed only on the front surface of the board, with the rear plane being parallel to the front surface of the board, for the user to grasp the board between the device and the palm of the user's hand placed behind the board; wherein said slanted floor is at an angle in the range of 5-45 degrees to said rear plane and to the front surface of the board, so that the user's fingers resting on the slanted floor are at an angle to the rear plane and to the front surface of the board.

In the Summary of the Invention above, and in the Detailed Description of the Invention, and in the accompanying drawings, reference is made to particular features of the invention. It is to be understood that the disclosure of the invention in this specification includes all possible combinations of such particular features. For example, where a particular feature is disclosed in the context of a particular aspect, a particular embodiment, or a particular Figure, that feature can also be used, to the extent appropriate, in the context of other particular aspects, embodiments, and Figures, and in the invention generally.

Although this invention has been described above with reference to particular means, materials and embodiments, it is to be understood that the invention is not limited to these disclosed particulars, but extends instead to all equivalents within the scope of the following claims.

The invention claimed is:

1. A protection device for use by a user grasping a martial arts board, the device comprising:

an enclosure surrounding and defining an interior space, the enclosure having a front wall for receiving an impact from a martial arts striker, an opposing slanted floor, and an open end for receiving distal portions of the fingers of the user in the interior space between the front wall and the slanted floor, so that the distal portions of the fingers push on the slanted floor for grasping the board between the device and the palm of the user's hand;

the slanted floor having a proximal extremity near the open end and an opposing distal extremity, a longitudinal central axis between the proximal and distal extremities, and a transverse central axis perpendicular to the longitudinal central axis and half way between said proximal and distal extremities;

the device further comprising a plurality of extension members that extend rearward from the enclosure, wherein at least a portion of multiple of the extension members are proximal of said transverse central axis and comprise a rearmost extremity on, and defining, a single rear plane parallel to a front surface of the board; and at least a portion of multiple of the extension members are distal of said transverse central axis and comprise a rearmost extremity on, and defining, the single rear plane, the rearmost extremities being for resting only on the front surface of the martial arts board;

wherein said slanted floor is at an angle to said rear plane so that the fingers are at an angle to the front surface of the board.

2. The protection device as in claim 1, wherein said plurality of extension members comprises multiple triangular walls that are each perpendicular to the slanted floor and each having a rearmost edge that is said rearmost extremity on the rear plane.

3. The protection device as in claim 1, wherein the plurality of extension members are selected from a group consisting of triangular walls, pyramids, pillars, bars, blocks, pegs, posts, straight walls, curved walls, geometric shapes, and combinations thereof.

4. The protection device as in claim 1, wherein said plurality of extension members comprises multiple walls having a first end connected to the slanted floor and having an opposing rear end, each wall having a different length between said first end and said rear end.

5. The protection device as in claim 1, wherein said plurality of extension members comprises multiple rows of pegs that are connected at a first end to the slanted floor and that have an opposing rear end, so that each peg has a peg length between the first end and the rear end, wherein each row of pegs have a different peg length.

6. The protective device as in claim 1, wherein the angle of the slanted floor to the rear plane is in the range of 5-45 degrees.

7. The protective device as in claim 1, wherein the angle of the slanted floor to the rear plane is in the range 16-20 degrees.

8. The protective device as in claim 1, wherein the interior space is divided into four sub-compartments by three dividing walls that are perpendicular to the slanted floor, the four sub-compartments being for receiving four of said fingers.

9. The protective device as in claim 1, wherein the front wall has a planar main portion that is at an angle to the slanted floor.

10. The protective device as in claim 1, wherein the device comprises no structure that extends rearward from said rear plane.

11. The protection device as in claim 1, wherein at least one of the plurality of extension members has a rounded rear end so that a portion of the rear end is the rearward extremity that lies on the rear plane.

12. The protection device as in claim 1, wherein at least one of the plurality of extension members has a rear end that is slanted relative to the slanted floor and the entire rear end is the rearward extremity that lies on the rear plane.

13. The protective device as in claim 1, wherein the front wall is material characterized by having a Shore Hardness in the range of 65 A to 90 A.

14. The protective device as in claim 1, wherein the front wall is material characterized by having a Shore Hardness of about 85 A.

15. The protective device as in claim 1, wherein the entire device is material characterized by having a Shore Hardness in the range of 65 A to 90 A.

16. The protective device as in claim 1, wherein the entire device is material characterized by having a Shore Hardness in the range of about 85 A.

17. The protective device as in claim 1, wherein the enclosure is material characterized by having a Shore Hardness in the range of 65 A to 90 A; and wherein each extension comprises material characterized by having a Shore Hardness in the range of 65 A to 90 A and, at the rearward extremity, material characterized by having a Shore Hardness in the range of 30 A to 64 A.

18. The protection device as in claim 1, wherein the plurality of extension members comprise curved walls.

19. A system for use in martial arts striking competition or practice, the system comprising:

a martial arts board having a front surface a and a rear surface and an outer perimeter edge surface; and a finger protective device comprising:

an enclosure surrounding and defining an interior space, the enclosure having a front wall for receiving an impact from a martial arts striker, an opposing slanted floor, and an open end for receiving a user's fingers into the interior space; and at least one extension member extending rearward from the enclosure and comprising a rearmost extremity defining a rear plane, wherein the rearmost extremity is placed only on the front surface of the board, with the rear plane being parallel to the front surface of the board, for the user to grasp the board between the device and the palm of the user's hand placed behind the board;

wherein said slanted floor is at an angle in the range of 5-45 degrees to said rear plane and to the front surface of the board, so that the user's fingers resting on the slanted floor are at an angle to the rear plane and to the front surface of the board.

20. The system as in claim 19, wherein the angle of the slanted floor to the rear plane and the front surface of the board is in the range 16-20 degrees.

21. The system as in claim 19, wherein the protective device comprises no structure that extends rearward of the rear plane.

22. The system as in claim 19, wherein the protective device comprises no structure that extends rearward of the front surface of the board along the outer perimeter edge surface of the board.

23. The system as in claim 19, wherein said at least one extension member comprises multiple triangular walls that are each perpendicular to the rear wall and each having a rearmost edge that is said rearmost extremity on the rear plane.

24. The system as in claim 19, wherein said at least one extension member comprises a plurality of extension member selected from a group consisting of: triangular walls, pyramids, pillars, bars, blocks, pegs, posts, straight walls, curved walls, geometric shapes, and combinations thereof.

25. The system as in claim 19, wherein said at least one extension member comprises multiple walls each connected to the slanted floor at a first end and having an opposing rear end, each wall having a different length between said first end and said rear end.

26. The system as in claim 19, wherein said at least one extension member comprises multiple rows of pegs that are connected at a first end to the slanted floor and that have an opposing rear end, so that each peg has a peg length between the first end and the rear end, wherein each row of pegs have a different peg length.

27. The system as in claim 19, wherein the slanted floor has a longitudinal central axis, and a transverse central axis perpendicular to said longitudinal central axis, and said at least one extension member includes: extensions members or extension member portions on the right, and extension members or extension member portions on the left, of the longitudinal central axis; and extension members or extension member portions located distal, and extensions members or extension member portions located proximal, of the transverse central axis; wherein all of said extension members and extension member portions have rearmost extremities on said rear plane.

28. The system as in claim 19, wherein the enclosure is material characterized by having a Shore Hardness in the range of 65 A to 90 A; and wherein each extension comprises material characterized by having a Shore Hardness in the range of 65 A to 90 A and, at the rearward extremity, material characterized by having a Shore Hardness in the range of 30 A to 64 A.

29. The system of claim 19, wherein said at least one extension member comprises a curved wall.

* * * * *